US011414627B2

(12) United States Patent
Schmiedel et al.

(10) Patent No.: US 11,414,627 B2
(45) Date of Patent: Aug. 16, 2022

(54) UNIT-DOSE DETERGENT PORTION COMPRISING A GRANULAR SOLID AND A VISCOELASTIC SOLID

(71) Applicant: Henkel AG & Co. KGaA, Duesseldorf (DE)

(72) Inventors: Peter Schmiedel, Duesseldorf (DE); Filiz Yapici, Duesseldorf (DE); Anna Klemmer, Duesseldorf (DE); Matthias Sunder, Duesseldorf (DE); Oliver Kurth, Langenfeld (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 67 days.

(21) Appl. No.: 16/714,387

(22) Filed: Dec. 13, 2019

(65) Prior Publication Data

US 2020/0115656 A1 Apr. 16, 2020

Related U.S. Application Data

(63) Continuation of application No. PCT/EP2018/065468, filed on Jun. 12, 2018.

(30) Foreign Application Priority Data

Jun. 16, 2017 (DE) ..... 102017210141.5

(51) Int. Cl.

| | |
|---|---|
| ***C11D 1/72*** | (2006.01) |
| ***C11D 3/20*** | (2006.01) |
| ***C11D 1/722*** | (2006.01) |
| ***C11D 3/43*** | (2006.01) |
| ***C11D 17/04*** | (2006.01) |

(52) U.S. Cl.

CPC ..... *C11D 3/2096* (2013.01); *C11D 1/721* (2013.01); *C11D 1/722* (2013.01); *C11D 3/2065* (2013.01); *C11D 3/43* (2013.01); *C11D 17/043* (2013.01)

(58) Field of Classification Search

CPC ..... C11D 1/72; C11D 1/722; C11D 17/042; C11D 17/043; C11D 17/044; C11D 17/045; C11D 17/003

See application file for complete search history.

(56) References Cited

U.S. PATENT DOCUMENTS

| | | | | |
|---|---|---|---|---|
| 9,809,784 | B2 * | 11/2017 | Wang | C11D 3/3723 |
| 2007/0244024 | A1 | 10/2007 | Barthel et al. | |
| 2010/0240569 | A1 * | 9/2010 | Boutique | C11D 1/66 510/299 |
| 2016/0137956 | A1 * | 5/2016 | Hayward | C11D 3/42 510/325 |

FOREIGN PATENT DOCUMENTS

| | | | |
|---|---|---|---|
| DE | 2857292 | A1 | 2/1980 |
| DE | 3324258 | A1 | 1/1984 |
| EP | 0066944 | A1 | 12/1982 |
| EP | 0185427 | A2 | 6/1986 |
| EP | 0241984 | A2 | 10/1987 |
| EP | 0241985 | A2 | 10/1987 |
| EP | 0253567 | A1 | 1/1988 |
| EP | 0272033 | A2 | 6/1988 |
| EP | 0274907 | A1 | 7/1988 |
| EP | 0357280 | A2 | 3/1990 |
| EP | 0442101 | A1 | 8/1991 |
| EP | 0885220 | B1 | 12/1998 |
| EP | 0885221 | B1 | 12/1998 |
| JP | H0987698 | A | 3/1997 |
| WO | 02086074 | A2 | 10/2002 |
| WO | 2007033743 | A1 | 3/2007 |
| WO | 2010108002 | A1 | 9/2010 |

OTHER PUBLICATIONS

Macosko, Christopher W. "Rheology Principles, Measurements and Applications", Linear Viscoelasticity. VCH, 1994, pp. 121-126.

Schramm, Gebhard. "Einfuehrung in Rheologie und Rheometrie". HAAKE Rheometer. Gebrueder HAAKE GmbH, 1995, pp. 156-173, Germany.

International Search Report PCT/EP2018/065468 Completed: Sep. 7, 2018 dated Sep. 24, 2018 5 pages.

* cited by examiner

*Primary Examiner* — Charles I Boyer

(74) *Attorney, Agent, or Firm* — Thomas G. Krivulka

(57) ABSTRACT

A portion including at least one chamber having a wall made of water-soluble material, wherein the portion includes a composition which based on the total weight of the composition contains a total amount of 0.1% to 80% by weight of at least one surfactant. Wherein the composition includes at least two phases, wherein a) a first phase is a granular mixture of a solid-state composition and b) a second phase is in the form of a viscoelastic, solid-state molding of a second composition which based on the total weight of the second composition contains a total amount of more than 1% by weight of at least one benzylidene alditol compound of formula (I). Wherein *—, n, m, $R^1$, $R^2$ and $R^3$, $R^4$, $R^5$ and $R^6$ are defined as storage-stable, aesthetic and releases the composition contained therein rapidly and effectively to provide a surfactant-containing liquor.

16 Claims, No Drawings

UNIT-DOSE DETERGENT PORTION COMPRISING A GRANULAR SOLID AND A VISCOELASTIC SOLID

FIELD OF THE INVENTION

The present invention relates to the technical field of portions as dosing aids for providing surfactant-containing liquors for treating substrates, in particular for cleaning hard surfaces, such as dishes, or for cleaning textiles.

BACKGROUND OF THE INVENTION

Detergents or cleaning agents are usually present in solid form (as powders or tablets, for example) or in liquid form (or also as a flowing gel). Liquid detergents or cleaning agents in particular are increasingly popular with consumers.

Solid detergents or cleaning agents have the advantage that, unlike liquid detergents or cleaning agents, they do not require any preservatives, and the contained ingredients (e.g. bleaching agents or enzymes) can be incorporated in a more stable manner. Liquid product formats are increasingly gaining acceptance in the market, particularly due to their quick solubility and the resulting quick availability of the active ingredients they contain. This gives the consumer the option of using abbreviated rinse cycles, for example for dishwashing applications, while still obtaining good cleaning performance. In order to guarantee this for pre-portioned compositions, the portions have to have, as a whole, good solubility in the solvent of the liquor, usually in water, and have to dissolve with as little residue as possible.

Consumers have grown accustomed to the convenient dosing of pre-portioned machine detergents or cleaning agents, such as dishwashing detergents or detergent pouches, and use these products in the form of tablets (solid detergents or cleaning agents) or in the form of pouches (also: pillow-like packaging) that are usually filled with at least one liquid detergent or cleaning agent. In addition to the above-mentioned advantages, however, the use of liquids has, for example, the disadvantage that the liquid detergent or cleaning agent flows out of the pouch of the portion when there are leaks therein.

Single-use portions in water-soluble pouches are therefore increasingly popular with consumers not only because they no longer come into contact with the chemical composition, but rather not least because of the attractive appearance of the pouches. The appearance of the dosage form is becoming increasingly important. Besides good cleaning performance and adequate storage stability, a good appearance is one of the reasons on which the selection of a product is based.

BRIEF SUMMARY OF THE INVENTION

From the perspective of consumers, it would also be desirable to combine the advantages of the liquid and solid product formats and provide a dosage form that is improved compared with the prior art, particularly for detergents or cleaning agents that are usually liquids. For this purpose, it has to be possible for the contained components to be portioned for single-use and for a visual appearance that is attractive to consumers to be achieved simultaneously.

Surprisingly, it has been found that this aim can be achieved by formulation of a flexible phase in the form of a viscoelastic shaped body which is combined with a granular mixture as a phase that is different therefrom (e.g. a powdered phase). It is particularly suitable for the granular mixture to be free-flowing, because, owing to the process, it is possible to fill the water-soluble wrapping in a more targeted manner, in particular when filling a cavity produced by deep-drawing. In addition, the visual appearance of the granular mixture (e.g. powder) can be better changed compared with a compressed tablet; in particular, texture differences, such as coarse and fine particles and particles or regions having different colors—in full or as colored flecks—can be used to improve a visually pleasing appearance. In addition, the granular mixture offers improved solubility in comparison with compressed tablets, even without the addition of disintegrants.

It has been found that by providing a portion having at least one phase of a granular mixture of a solid composition and at least one phase in the form of a viscoelastic, solid shaped body of a second composition containing a benzylidene alditol compound, the above problems are solved. The invention therefore relates, in a first embodiment, to a portion for providing a surfactant-containing liquor, comprising at least one chamber having a wall made of water-soluble material, the portion comprising an agent which contains, based on the total weight of the agent, a total amount of from 0.1 to 80 wt. % of at least one surfactant, said agent comprising at least two phases, and a) a first phase is a granular mixture of a solid composition, and b) a second phase is present as a viscoelastic, solid shaped body of a second composition, which contains, based on the total weight of the second composition, a total amount of more than 1 wt. % of at least one benzylidene alditol compound of formula (I), (I)

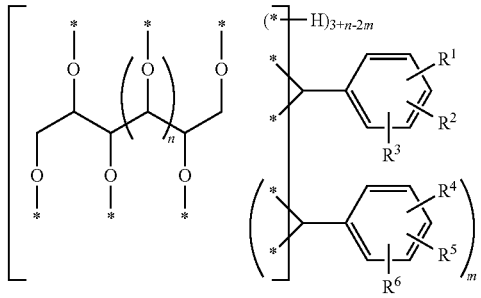

where

*— represents a covalent single bond between an oxygen atom of the alditol backbone and the provided functional group, n represents 0 or 1, preferably 1, m represents 0 or 1, preferably 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxyl group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxyl group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring.

Particularly preferably, a second embodiment of the invention is a portion for providing a surfactant-containing liquor, comprising at least one chamber having a wall made of water-soluble material, the portion comprising an agent which contains, based on the total weight of the agent, a total amount of from 0.1 to 80 wt. % of at least one surfactant, said agent comprising at least two phases, and a) a first phase is a granular mixture of a solid composition, and b) a second phase is present as a viscoelastic, solid shaped body of a second composition, which contains, based on the total weight of the second composition, a total amount of more than 1 wt. % of at least one benzylidene alditol compound of formula (I), (I)

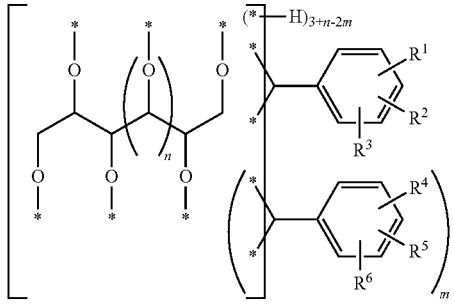

where

*— represents a covalent single bond between an oxygen atom of the alditol backbone and the provided functional group, n represents 0 or 1, preferably 1, m represents 0 or 1, preferably 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxyl group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxyl group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, with the proviso that the second composition of the viscoelastic, solid shaped body has a storage modulus of between $10^3$ Pa and $10^8$ Pa, preferably between $10^4$ Pa and $10^8$ Pa and a loss modulus (in each case at 20° C., with a deformation of 0.1% and a frequency of 1 Hz), and the storage modulus in the frequency range between $10^{-2}$ Hz and 10 Hz is at least twice as great as the loss modulus. More preferably, the second composition of the viscoelastic, solid shaped body has a storage modulus in a range of from $10^5$ Pa to $10^7$ Pa.

So as to further optimize the stability properties of the above-mentioned shaped body, it is preferable for the storage modulus to be at least five times as great as the loss modulus, particularly preferably at least ten times as great as the loss modulus (in each case at 20° C., with a deformation of 0.1% and a frequency of 1 Hz).

The compositions of the invention preferably have a yield point. The yield point refers to the lowest stress (force per surface area) above which a plastic substance behaves rheologically, like a liquid. It is given in pascals (Pa).

The yield point of the compositions was measured using an AR G2-type rotational rheometer from TA-Instruments. This is what is known as a controlled shear stress rheometer. In order to measure a yield point using a controlled shear stress rheometer, various methods are described in the literature that are known to a person skilled in the art.

In order to determine the yield points within the context of the present invention, the following was carried out at 20° C.:

Shear stress σ increasing at intervals over time was applied to the samples in the rheometer in a stepped-flow procedure. For example, the shear stress can be increased from the smallest possible value (e.g. 2 mPa) to e.g. 10 Pa over the course of 10 minutes with 10 points per shear stress decade. In the process, the time interval is selected such that the measurement is carried out "quasistatically", i.e., such that the deformation of the sample for each specified shear stress value can come into equilibrium. The equilibrium deformation γ of the sample is measured as a function of this shear stress. The deformation is plotted against the shear stress in a log-log plot. Provided that the sample tested has a yield point, a distinction can clearly be made between two regions in this plot. Below a certain shear stress, purely elastic deformation occurs in accordance with Hooke's law. The gradient of the curve γ(σ) (log-log plot) in this region is one. Above this shear stress, the yield region begins and the gradient of the curve rises steeply. The shear stress at which the curve deviates sharply, i.e. the transition from elastic to plastic deformation, marks the yield point. It is possible to easily determine the break point by applying tangents to the two parts of the curve. Samples without a yield point do not have a characteristic deviation in the γ(σ) function.

The solid, viscoelastic composition according to the invention preferably has a yield point in the range of from 8 to 350 Pa, more preferably from 10 to 320 Pa (in each case measured used a rotational rheometer, cone-plate measuring system with a 40 mm diameter and 2° opening angle at a temperature of 20° C.).

All definitions and preferred embodiments mentioned below apply equally to the first embodiment and the second embodiment, unless defined otherwise.

DETAILED DESCRIPTION OF THE INVENTION

In providing a surfactant-containing liquor, the viscoelastic, solid composition combines all the use advantages of a liquid composition, and can be integrated into the portion together with the granular mixture in order to thus achieve an aesthetic product shape that has a good dissolution profile and an excellent performance profile with respect to the substrate. WO 2010/108002 discloses structured liquid surfactant compositions that contain at most 1 wt. % of a benzylidene alditol compound as a structuring agent. Viscoelastic, solid surfactant compositions containing benzylidene alditol compounds are not described in the above document.

The viscoelastic, solid composition of the present invention is stable in storage and shape, taken alone or in combination with the granular mixture of the portion, particularly when the viscoelastic, solid composition and the granular mixture are in direct contact. The viscoelastic composition does not undergo syneresis, even after long periods of storage. If the granular mixture is in direct contact with the viscoelastic composition of the shaped body, then the two phases do not mix even after prolonged storage. The composition of the granular mixture also remains stable.

A portion is an independent dosing unit having at least one chamber. Adding together all the chambers, the compositions produced overall therein produce the product to be dosed of the portion (here an agent). A chamber is a space delimited by walls (e.g. by a film), which space can also exist without the product to be dosed (optionally by changing its shape). A layer of a surface coating is not explicitly covered by the definition of a wall.

The water-soluble material forms walls of the chamber and thereby wraps the compositions of the agent.

According to the invention, the wall is made of a water-soluble material. The water solubility of the material can be determined by means of a square film of said material (film: 22×22 mm with a thickness of 76 μm) fixed in a square frame (edge length on the inside: 20 mm) according to the following measurement protocol. Said framed film is submerged into 800 ml distilled water, temperature-controlled to 20° C., in a 1 liter beaker with a circular base (Schott, Mainz, beaker glass 1000 ml, low shape), so that the surface of the tensioned film is arranged at a right angle to the base of the beaker glass, the upper edge of the frame is 1 cm below the water surface, and the lower edge of the frame is oriented in parallel with the base of the beaker glass such that the lower edge of the frame extends along the radius of the base of the beaker glass and the center of the lower edge of the frame is arranged above the center of the radius of the beaker glass bottom. The material should dissolve within 600 seconds when stirred (stirring speed magnet stirrer 300 rpm, stirring rod: 6.8 cm long, diameter 10 mm), such that no solid film particles at all can be seen with the naked eye. The walls are preferably made of a water-soluble film. According to the invention this film may preferably have a thickness of at most 150 μm (particularly preferably of at most 120 μm). Preferred walls are thus produced from a water-soluble film and have a thickness of at most 150 μm (particularly preferably of at most 120 μm, more particularly preferably of at most 90 μm).

Water-soluble portions of this kind can be made either by means of (preferably vertical) form fill sealing (FFS) processes or thermoforming processes. Particularly preferably, walls of at least one chamber are produced by sealing at least one film made of water-soluble material, in particular by sealing within the context of a form fill sealing process. Preferred embodiments of the FFS process will be described later (vide infra).

The water-soluble material preferably contains at least one water-soluble polymer. The water-soluble material also preferably contains a water-soluble film material selected from polymers or polymer mixtures. The wrapping may be made up of one or of two or more layers of the water-soluble film material. The water-soluble film material of the first layer and of the additional layers, if present, may be the same or different.

It is preferable for the water-soluble material to contain polyvinyl alcohol or a polyvinyl alcohol copolymer.

Suitable water-soluble films as the water-soluble material are preferably based on a polyvinyl alcohol or a polyvinyl alcohol copolymer of which the molecular weight is in each case in the range of from 10,000 to 1,000,000 $gmol^{-1}$, preferably 20,000 to 500,000 $gmol^{-1}$, particularly preferably 30,000 to 100,000 $gmol^{-1}$ and in particular 40,000 to 80,000 $gmol^{-1}$.

Polyvinyl alcohol is usually prepared by hydrolysis of polyvinyl acetate, since the direct synthesis route is not possible. The same applies to polyvinyl alcohol copolymers, which are correspondingly prepared from polyvinyl acetate copolymers. It is preferable for at least one layer of the water-soluble material to include a polyvinyl alcohol of which the degree of hydrolysis is from 70 to 100 mol. %, preferably from 80 to 90 mol. %, particularly preferably from 81 to 89 mol. %, and in particular from 82 to 88 mol. %.

Polymers selected from the group comprising acrylic acid-containing polymers, polyacrylamides, oxazoline polymers, polystyrene sulfonates, polyurethanes, polyesters, polyethers, polylactic acid, and/or mixtures of the above polymers may additionally be added to the film material suitable as the water-soluble material.

Preferred polyvinyl alcohol copolymers include, in addition to vinyl alcohol, dicarboxylic acids as further monomers. Suitable dicarboxylic acids are itaconic acid, malonic acid, succinic acid and mixtures thereof, with itaconic acid being preferred.

Polyvinyl alcohol copolymers which include, in addition to vinyl alcohol, an ethylenically unsaturated carboxylic acid, or the salt or ester thereof, are also preferred. Polyvinyl alcohol copolymers of this kind particularly preferably contain, in addition to vinyl alcohol, acrylic acid, methacrylic acid, acrylic acid ester, methacrylic acid ester or mixtures thereof.

The film material used as water-soluble material has a preferred thickness in a range of from 65 to 180 μm, in particular from 70 to 150 μm, more preferably 75 to 120 μm.

A bittering agent is preferably incorporated in a uniform manner into the above-mentioned water-soluble material of the walls of the portion, in order to increase product safety. Corresponding embodiments of the water-soluble material having a bittering agent are described in EP-B1-2 885 220 and EP-B1-2 885 221. A preferred bittering agent is denatonium benzoate.

Suitable water-soluble films for use as the water-soluble material of the wall of the water-soluble portion according to the invention are films which are sold by MonoSol LLC, under the designations M8630. Other suitable films include films having the designations Solublon® PT, Solublon® KA, Solublon® KC or Solublon® KL from Aicello Chemical Europe GmbH, or the VF-HP films from Kuraray, or HiSelon SH2312 from Nippon Gohesi.

The agent, and the components thereof, such as the viscoelastic, solid composition and the granular mixture, may contain, in addition to the compulsory ingredients, other optional ingredients. The total amounts of each ingredient, if necessary, are selected from predetermined weight ranges such that, together with the amounts of the remaining ingredients for said composition, based on the total weight thereof, they yield 100 wt. %.

A substance (e.g. a composition) is solid according to the definition of the invention if it is in the solid physical state at 20° C. and 1013 mbar.

A substance (e.g. a composition of a shaped body) is, according to the definition known to a person skilled in the art, viscoelastic and solid when the storage modulus of the substance is greater than the present loss modulus at 20° C. When mechanical forces are applied to the substance, it has the properties of an elastic solid, and also exhibits a viscosity similar to that of a liquid. The termini of the storage modulus and loss modulus, and of the determination of the values of these moduli, are well known to a person skilled in the art (cf. Christopher W. Macosco, "Rheology Principles, Measurements and Applications," VCH, 1994, page 121 et seq. or Gebhard Schramm, "*Einführung in die Rheologie und Rheometrie*," Karlsruhe, 1995, page 156 et seq. or WO 02/086074 A1, page 2, third paragraph to page 4, end of the first paragraph).

In the context of this invention, the rheological characterization is carried out by means of a rotational rheometer, for example type AR G2 from TA-Instruments or "Kinexus" from Malvern, using a cone-plate measuring system with a 40 mm diameter and 2° opening angle at a temperature of 20° C. The above-mentioned rheometer is a shear stress controlled rheometer. However, the determination can also be carried out using other instruments or measurement geometries of comparable specifications.

The measurement of the storage modulus (abbreviation: G') and of the loss modulus (abbreviation: G") (the unit in each case was Pa) is taken using the above-described equipment in an experiment involving oscillating deformation. For this purpose, the linear viscoelastic region is first determined in a stress sweep experiment. In this case, the shear stress amplitude is increased at a constant frequency of, for example, 1 Hz. The moduli G' and G" are plotted in a log-log plot. Either the shear stress amplitude or the (resulting) deformation amplitude can be plotted on the x axis. The storage modulus G' is constant below a certain shear stress amplitude or deformation amplitude, above which it collapses. The break point is expediently determined by applying tangents to the two portions of the curve. The corresponding deformation amplitude or shear stress amplitude is usually referred to as "critical deformation" or "critical shear stress".

In order to determine the frequency dependence of the moduli, a frequency ramp, e.g. between 0.01 Hz and 10 Hz, is performed at a constant deformation amplitude. The deformation amplitude has to be selected such that it is within the linear range, i.e. below the above-mentioned critical deformation. In the case of the compositions according to the invention, a deformation amplitude of 0.1% has been found to be suitable. The moduli G' and G" are plotted against the frequency in a log-log plot.

A substance (e.g. a composition) is liquid according to the definition of the invention if it is in the liquid physical state at 20° C. and 1013 mbar.

A chemical compound is an organic compound if the molecule of the chemical compound contains at least one covalent bond between carbon and hydrogen. This definition applies, mutatis mutandis, to, inter alia, "organic bleach activators" as the chemical compound.

By implication from the definition of an organic compound, a chemical compound is an inorganic compound if the molecule of the chemical compound does not contain a covalent bond between carbon and hydrogen.

The average molar masses specified for polymeric ingredients in the context of this application are always, unless explicitly stated otherwise, weight-average molar masses $M_w$, which can in principle be determined by means of gel permeation chromatography using an RI detector, it being expedient for the measurement to be carried out as per an external standard.

Within the meaning of the present invention, a phase is a spatial region in which physical parameters and the chemical composition are homogeneous. One phase differs from another phase in terms of its different features, such as ingredients, physical properties, external appearance, etc. Preferably, different phases can be differentiated visually from one another. A first phase can thus be clearly distinguished by a consumer from the at least one second phase. If the agent in the portion according to the invention has more than one first phase, then they can preferably also each be distinguished from one another with the naked eye because of their different coloration, for example. The same holds when two or more second phases are present. In this case as well, a visual differentiation of the phases, for example on the basis of a difference in coloration or transparency, is preferably possible. Within the meaning of the present invention, phases are thus self-contained regions that can be differentiated visually from one another by a consumer with the naked eye. The individual phases can have different properties during use.

A granular mixture is formed from a large number of loose, solid particles, which in turn comprise what are known as grains. A grain is a name for the particulate constituents of powders (grains are the loose, solid particles), dusts (grains are the loose solid particles), granules (loose, solid particles are agglomerates of several grains) and other granular mixtures. A preferred embodiment of the granular mixture of the composition of the first phase is the powder or the granular material. Said solid particles of the granular mixture in turn preferably have a particle diameter $X_{50,3}$ (volume average) of from 10 to 1,500 μm, more preferably from 200 μm to 1,200 μm, particularly preferably from 600 μm to 1,100 μm. Said particle sizes can be determined by sieving or by means of a Camsizer particle size analyzer from the company Retsch.

The granular mixture of the solid composition of the present invention, which is used as a first phase, is preferably present in free-flowing form (particularly preferably as a free-flowing powder or free-flowing granular material). The agent of the portion according to the invention thus comprises at least one first phase of a free-flowing, granular mixture of a solid composition, and at least one previously defined second phase.

The free-flowing ability of a granular mixture relates to its ability to flow freely under its own weight out of a flow-test funnel having an outlet of 16.5 mm diameter. The free-flowing quality is determined by measuring the outflow time of 1,000 ml of granular mixture out of a standardized flow-test funnel, which is initially closed in its outlet direction and has an outlet of 16.5 mm in diameter, by measuring the time for the complete outflow of the powder, after opening the outlet, and comparing it with the flow-out speed (in seconds) of a standard test sand of which the flow-out speed is defined as 100%. The defined sand mixture for calibrating the flow apparatus is dry sea sand.

Granular mixtures having a free-flowing ability in %, compared with the above-mentioned standard test substance, of greater than 40%, preferably greater than 55%, in particular greater than 60%, particularly preferably between 63% and 80%, for example between 65% and 75%, are particularly suitable.

Lower values for the free-flowing ability are rather unsuitable, since from a procedural point of view, precise dosing of the granular mixture is necessary. In particular the values greater than 60% have been found to be advantageous, since the good dosing ability of the granular mixture leads to only minor fluctuations in the dosed amount or composition. More accurate dosing leads to consistent product performance, and economic losses due to overdosing are thus avoided. It is further advantageous for the granular mixture to be well dosed so that a faster sequence of the dosing process can be achieved. In addition, such a good free-flowing ability makes it easier to avoid the situation whereby the granular mixture reaches the part of the water-soluble wrapping which is provided for producing the sealing seam and therefore ought to remain as free as possible of granular mixture.

Within the meaning of the invention, a surfactant-containing liquor is a liquid preparation for treating a substrate that can be obtained by using a surfactant-containing agent which has been diluted with at least one solvent (preferably water). Hard surfaces (such as dishes) or fabrics or textiles (such as clothing), for example, are considered as the substrate.

The portions according to the invention are preferably used to provide a surfactant-containing liquor for mechanical cleaning processes, as are carried out, for example, by a dishwasher or a washing machine for textiles.

A shaped body is a single body that stabilizes itself in the shape imparted to it. This dimensionally stable body is formed from a molding compound (e.g. a composition) in such a way that this molding compound is deliberately brought into a predetermined shape, for example by pouring a liquid composition into a casting mold and then curing the liquid composition, for example as part of a sol-gel process.

"At least one," as used herein, refers to 1, 2, 3, 4, 5, 6, 7, 8, 9 or more. In connection with components of the compositions described herein, this information does not refer to the absolute amount of molecules, but to the type of the component. "At least one inorganic base" therefore signifies, for example, one or more different inorganic bases, i.e. one or more different types of inorganic bases. Together with stated amounts, the amounts stated refer to the total amount of the correspondingly designated type of component.

If, in the context of the application, numerical ranges are defined from one number to another number, then the limit values are included in the range.

If, in the context of the application, numerical ranges are defined between one number and another number, then the limit values are not included in the range.

In the portion according to the invention an agent is located which comprises at least two compositions, each forming a phase. Said compositions are contained in the portion in a chamber formed of water-soluble material. In this case, each composition of the agent can be produced in a separate chamber, or at least two compositions are located in one and the same chamber. Portions that are characterized in that the first phase and the second phase are contained together in the same chamber are preferred.

The portion according to the invention may also contain more than one first phase and/or more than one second phase.

Portions in which the granular mixture of the first phase is in direct contact with the shaped body of the second phase are also preferred according to the invention.

The agent of the portion according to the invention contains, based on the total weight of the agent, a total amount of from 0.1 to 80 wt. % of surfactant. The surfactant may be contained in said solid composition of the granular mixture (i.e. in the first phase), in said second composition of the shaped body (i.e. in the second phase) or in a further composition (further phase) of the agent, or in a plurality of these above-mentioned compositions. In total, a surfactant content in the previously defined amount range results across all compositions produced in the portion.

Suitable surfactants according to the invention are preferably anionic surfactants, non-ionic surfactants, zwitterionic surfactants, amphoteric surfactants or cationic surfactants.

Preferred portions contain an agent which, based on the total weight of the agent, contains a total amount of from 0.1 to 5.0 wt. % of at least one surfactant. Agents of this kind are suitable for the use according to the invention, in particular in a dishwasher. It is in turn particularly preferable for the agent to contain at least one non-ionic surfactant.

Preferred portions contain an agent which, based on the total weight of the agent, contains a total amount of from 5 to 80 wt. %, particularly preferably from 20 to 70 wt. %, very particularly preferably from 25 to 65 wt. %, of at least one surfactant. Portions containing such agents are suitable for the use according to the invention; however, they are particularly suitable for use in a washing machine for textile washing. It is in turn particularly preferable for the agent to contain at least one anionic surfactant and optionally also at least one non-ionic surfactant.

A portion that is preferred according to the invention is characterized in that the agent contained therein contains at least one anionic surfactant. Portions comprising an anionic surfactant can be used in the fields of application mentioned above; however, they are preferably suitable for washing textiles, particularly preferably for use in a washing machine for textile washing, in particular for dosing into the drum of a washing machine for textile washing.

If the agent contained in the portion contains an anionic surfactant, it is in turn preferable for anionic surfactant to be contained in a total amount of from 8 to 70 wt. %, in particular from 25 to 60 wt. %, more preferably from 30 to 40 wt. %, based on the total weight of the agent.

Sulfonates and/or sulfates can preferably be used as the anionic surfactant.

Surfactants of the sulfonate type that can be used are preferably $C_{9-13}$ alkylbenzene sulfonates, olefin sulfonates, i.e. mixtures of alkene and hydroxyalkane sulfonates, and disulfonates, as obtained, for example, from $C_{12-18}$ monoolefins having a terminal or internal double bond by way of sulfonation with gaseous sulfur trioxide and subsequent alkaline or acid hydrolysis of the sulfonation products. $C_{12-18}$ alkane sulfonates and the esters of α-sulfofatty acids (ester sulfonates) are also suitable, for example the α-sulfonated methyl esters of hydrogenated coconut, palm kernel or tallow fatty acids.

Particularly preferred agents of the portions according to the invention contain, as the anionic surfactant, at least one compound of formula (T1)

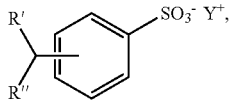

(T1)

in which

R' and R" signify, independently of one another, H or alkyl, and together contain 9 to 19, preferably 9 to 15 and in particular 9 to 13, C atoms, and $Y^+$ is a monovalent cation or the nth part of an n-valent cation (in particular $Na^+$).

The alkali salts and in particular the sodium salts of the sulfuric acid half-esters of $C_{12}$-$C_{18}$ fatty alcohols, for example from coconut fatty alcohol, tallow fatty alcohol, lauryl alcohol, myristyl alcohol, cetyl alcohol or stearyl alcohol, or of $C_{10}$-$C_{20}$ oxo alcohols and the half-esters of secondary alcohols having these chain lengths are preferred as alk(en)yl sulfates. From a washing perspective, $C_{12}$-$C_{16}$ alkyl sulfates, $C_{12}$-$C_{15}$ alkyl sulfates and $C_{14}$-$C_{15}$ alkyl sulfates are preferred. 2,3-alkyl sulfates are also suitable anionic surfactants.

Fatty alcohol ether sulfates, such as the sulfuric acid monoesters of straight-chain or branched $C_{7-21}$ alcohols ethoxylated with 1 to 6 mol ethylene oxide, such as 2-methyl-branched $C_{9-11}$ alcohols having, on average, 3.5 mol ethylene oxide (EO) or $C_{12-18}$ fatty alcohols having 1 to 4 EO, are also suitable.

Other suitable anionic surfactants are soaps. Saturated and unsaturated fatty acid soaps are suitable, such as the salts of lauric acid, myristic acid, palmitic acid, stearic acid, (hydrogenated) erucic acid and behenic acid, and in particular soap mixtures derived from natural fatty acids, such as coconut, palm kernel, olive oil or tallow fatty acids.

The anionic surfactants, and the soaps, can be present in the form of sodium, potassium, magnesium or ammonium salts thereof. The anionic surfactants are preferably present in the form of the ammonium salts thereof. Preferred counterions for the anionic surfactants are the protonated forms of choline, triethylamine, monoethanolamine or methylethylamine.

In a very particularly preferred embodiment, the agent of the portion contains an alkyl benzene sulfonic acid, in particular $C_{9-13}$ alkyl benzene sulfonic acid, neutralized with monoethanolamine, and/or a fatty acid neutralized with monoethanolamine.

A preferred portion according to the invention contains an agent containing at least one anionic surfactant selected from the group consisting of $C_{8-18}$ alkylbenzene sulfonates, olefin sulfonates, $C_{12-18}$ alkane sulfonates, ester sulfonates, alkyl sulfates, alkenyl sulfates, fatty alcohol ether sulfates and mixtures thereof.

In a preferred embodiment, the agent contained in the portion according to the invention contains at least one non-ionic surfactant.

The at least one non-ionic surfactant can be any known non-ionic surfactant that is suitable for the purpose according to the invention.

In a preferred embodiment of the invention, the agents described herein contain, as a non-ionic surfactant, at least one fatty alcohol alkoxylate having the following formula (T2)

$$R'—O—(XO)_m—H \quad (T2)$$

where R' is a linear or branched $C_8$-$C_{18}$ alkyl functional group, an aryl functional group or alkylaryl functional group, XO is independently an ethylene oxide (EO) or propylene oxide (PO) group, and m is an integer from 1 to 50. In the above formula, R' represents a linear or branched, substituted or unsubstituted alkyl functional group. In a preferred embodiment of the present invention, $R^1$ is a linear or branched alkyl functional group having 5 to 30 carbon atoms, preferably 7 to 25 carbon atoms, and in particular 10 to 19 carbon atoms. Preferred functional groups R' are selected from decyl, undecyl, dodecyl, tridecyl, tetradecyl, pentadecyl, hexadecyl, heptadecyl, octadecyl, nonadecyl functional groups and mixtures thereof, the representatives that have an even number of carbon atoms being preferred. Particularly preferred functional groups R' are derived from fatty alcohols having 12 to 19 carbon atoms, for example from coconut fatty alcohol, tallow fatty alcohol, lauryl, myristyl, cetyl or stearyl alcohol, or from oxo alcohols having 10 to 19 carbon atoms.

XO in formula (T2) is an ethylene oxide (EO) or propylene oxide (PO) group, preferably an ethylene oxide group.

The index m in formula (T2) is an integer from 1 to 50, preferably from 2 to 20, and more preferably from 2 to 10. In particular, m is 3, 4, 5, 6 or 7. The agent according to the invention may contain mixtures of non-ionic surfactants that have different degrees of ethoxylation.

In summary, particularly preferred fatty alcohol alkoxylates are those of the formula

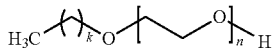

where k=9 to 17, and m=3, 4, 5, 6, or 7. Very particularly preferred representatives are fatty alcohols having 10 to 18 carbon atoms and 7 EO (k=11 to 17, m=7).

Fatty alcohol ethoxylates of this kind are available under the trade names Dehydol® LT7 (Cognis), Lutensol® AO7 (BASF), Lutensol® M7 (BASF), and Neodol® 45-7 (Shell Chemicals).

Particularly preferably, the portions according to the invention contain, as agents, non-ionic surfactants from the group of alkoxylated alcohols. Non-ionic surfactants that are preferably used are alkoxylated, advantageously ethoxylated, in particular primary alcohols having preferably 8 to 18 C atoms and, on average, 1 to 12 mol ethylene oxide (EO) per mol of alcohol, in which the alcohol functional group can be linear or preferably methyl-branched in the 2 position, or can contain linear and methyl-branched functional groups in admixture, as are usually present in oxo alcohol functional groups. However, alcohol ethoxylates having linear functional groups of alcohols of native origin having 12 to 18 C atoms, for example from coconut, palm, tallow fatty or oleyl alcohol, and an average of 2 to 8 EO per mol of alcohol, are particularly preferred. Examples of preferred ethoxylated alcohols include $C_{12-14}$ alcohols having 3 EO or 4 EO, $C_{8-11}$ alcohol having 7 EO, $C_{13-15}$ alcohols having 3 EO, 5 EO, 7 EO or 8 EO, $C_{12-18}$ alcohols having 3 EO, 5 EO or 7 EO, and mixtures thereof, such as mixtures of $C_{12-14}$ alcohol having 3 EO and $C_{12-18}$ alcohol having 5 EO.

Preferred alcohol ethoxylates have a narrowed homolog distribution (narrow range ethoxylates, NRE). In addition to these non-ionic surfactants, fatty alcohols having more than 12 EO can also be used, in particular as cleaning agents for automatic dishwashing. Examples of these are tallow fatty alcohols having 14 EO, 25 EO, 30 EO, or 40 EO.

Ethoxylated non-ionic surfactants are particularly preferably used which were obtained from $C_{6-20}$ monohydroxy alkanols or $C_{6-20}$ alkyl phenols or $C_{16-20}$ fatty alcohols and more than 12 mol, preferably more than 15 mol, and in particular more than 20 mol, ethylene oxide per mol of alcohol. A particularly preferred non-ionic surfactant is obtained from a straight-chain fatty alcohol having 16 to 20 carbon atoms ($C_{16-20}$ alcohol), preferably from a Cis alcohol and at least 12 mol, preferably at least 15 mol and in particular at least 20 mol, ethylene oxide. Among these, what are referred to as "narrow range ethoxylates" are particularly preferred.

Surfactants that are preferably used come from the groups of the alkoxylated non-ionic surfactants, in particular the ethoxylated primary alcohols and mixtures of these surfactants with structurally complex surfactants such as polyoxypropylene/polyoxyethylene/polyoxypropylene ((PO/EO/PO) surfactants). Such (PO/EO/PO) non-ionic surfactants are also characterized by good foam control.

In the context of the present invention, low-foaming non-ionic surfactants which have alternating ethylene oxide and alkylene oxide units have been found to be particularly preferred non-ionic surfactants, in particular for cleaning agents for automatic dishwashing. Among these, in turn, surfactants having EO-AO-EO-AO blocks are preferred, with one to ten EO groups or AO groups being bonded to one another before a block of the other group follows. Here, non-ionic surfactants of the general formula $$R^1—O—(CH_2—CH_2—O)_w—(CH_2—\underset{\underset{R^2}{|}}{CH}—O)_x—(CH_2—CH_2—O)_y—(CH_2—\underset{\underset{R^3}{|}}{CH}—O)_z—H$$

are preferred, in which $R^1$ represents a straight-chain or branched, saturated or mono- or polyunsaturated $C_{6-24}$ alkyl or alkenyl functional group; each $R_2$ and $R_3$ group is selected, independently of one another, from $—CH_3$, $—CH_2CH_3$, $—CH_2CH_2—CH_3$, $—CH(CH_3)_2$; and the indices w, x, y and z represent, independently of one another, integers from 1 to 6.

Preferred non-ionic surfactants of the above formula can be prepared using known methods, from the corresponding alcohols $R^1$—OH and ethylene or alkylene oxide. The $R^1$ functional group in the above formula can vary depending on the origin of the alcohol. If native sources are used, the $R^1$ functional group has an even number of carbon atoms and is generally unbranched, with the linear functional groups of alcohols of native origin having 12 to 18 C atoms, such as coconut, palm, tallow fatty or oleyl alcohol, for example, being preferred. Some examples of alcohols that are available from synthetic sources are the Guerbet alcohols or functional groups that are methyl-branched or linear and methyl-branched in the 2 position in admixture, such as those usually present in oxo alcohol functional groups. Irrespective of the type of alcohol used to prepare the non-ionic surfactants contained in the agents, non-ionic surfactants are preferred in which $R^1$ represents an alkyl functional group having 6 to 24, preferably 8 to 20, particularly preferably 9 to 15, and in particular 9 to 11, carbon atoms in the above formula.

Besides propylene oxide, butylene oxide in particular is worthy of consideration as an alkylene oxide unit that is contained alternately with the ethylene oxide unit in the preferred non-ionic surfactants. However, other alkylene oxides in which $R^2$ and $R^3$ are selected, independently of one another, from $—CH_2CH_2—CH_3$ and $—CH(CH_3)_2$ are also suitable. Preferably, non-ionic surfactants of the above formula are used in which $R^2$ and $R^3$ represent a functional group $—CH_3$; w and x, independently of one another, represent values of 3 or 4; and y and z, independently of one another, represent values of 1 or 2.

Further preferably used non-ionic surfactants, in particular for cleaning agents for automatic dishwashing, are non-ionic surfactants of the general formula $$R^1O(AlkO)_xM(OAlk)_yOR^2,$$

where $R^1$ and $R^2$ represent, independently of one another, a branched or unbranched, saturated or unsaturated, optionally hydroxylated alkyl functional group having 4 to 22 carbon atoms; Alk represents a branched or unbranched alkyl functional group having 2 to 4 carbon atoms; x and y represent, independently of one another, values of between 1 and 70; and M represents an alkyl functional group from the group $CH_2$, $CHR^3$, $CR^3R^4$, $CH_2CHR^3$ and $CHR^3CHR^4$, where $R^3$ and $R^4$ represent, independently of one another, a branched or unbranched, saturated or unsaturated alkyl functional group having 1 to 18 carbon atoms.

Preferred in this case are non-ionic surfactants of the general formula $$R^1—CH(OH)CH_2—O(CH_2CH_2O)_xCH_2CHR(OCH_2CH_2)_y—CH_2CH(OH)—R^2,$$

where R, $R^1$ and $R^2$, independently of one another, represent an alkyl functional group or alkenyl functional group having 6 to 22 carbon atoms; x and y, independently of one another, represent values of between 1 and 40.

Preferred in this case are, in particular, compounds of the general formula $R^1—CH(OH)CH_2—O(CH_2CH_2O)_xCH_2CHR(OCH_2CH_2)_yO—CH_2CH(OH)—R^2$, in which R represents a linear, saturated alkyl functional group having 8 to 16 carbon atoms, preferably 10 to 14 carbon atoms, and n and m represent, independently of one another, values of from 20 to 30. Such compounds can be obtained, for example, by reacting alkyl diols HO—CHR—$CH_2$—OH with ethylene oxide, with a reaction with an alkyl epoxide being performed subsequently in order to close the free OH functions whilst forming a dihydroxy ether.

Preferred non-ionic surfactants are, in particular for cleaning agents for automatic dishwashing, those of the general formula $R^1—CH(OH)CH_2O—(AO)_w-(AO)_x-(A''O)_y-(A'''O)_z—R^2$, in which

- $R^1$ represents a straight-chain or branched, saturated or mono- or polyunsaturated $C_{6-24}$ alkyl functional group or alkenyl functional group;
- $R^2$ represents hydrogen or a linear or branched hydrocarbon functional group having 2 to 26 carbon atoms;
- A, A', A'' und A''' represent, independently of one another, a functional group from the group $—CH_2CH_2$, $—CH_2CH_2—CH_2$, $—CH_2—CH(CH_3)$, $—CH_2—CH_2—CH_2—CH_2$, $—CH_2—CH(CH_3)—CH_2—$, $—CH_2—CH(CH_2—CH_3)$;
- w, x, y and z represent values of between 0.5 and 120, where x, y and/or z can also be 0.

By adding the above-mentioned non-ionic surfactants of general formula $R^1—CH(OH)CH_2O-(AO)_w-(A'O)_x(A'O)_x-(A''0)_y-(A'''O)_z—R^2$, hereinafter also referred to as "hydroxy mixed ethers," the cleaning performance of preparations according to the invention can be surprisingly improved, particularly both in comparison with surfactant-free systems and in comparison with systems that contain alternative non-ionic surfactants, such as those from the group of polyalkoxylated fatty alcohols, for example.

By using these non-ionic surfactants having one or more free hydroxyl groups on one or both terminal alkyl functional groups, the stability of the enzymes that may be additionally contained in the agents according to the invention can be significantly improved.

In particular, those end-capped poly(oxyalkylated) non-ionic surfactants are preferred, in particular for cleaning agents for automatic dishwashing, which, according to the following formula

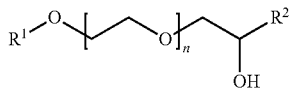

besides a functional group $R^1$, which represents linear or branched, saturated or unsaturated, aliphatic or aromatic hydrocarbon functional groups having 2 to 30 carbon atoms, preferably having 4 to 22 carbon atoms, also have a linear or branched, saturated or unsaturated, aliphatic or aromatic hydrocarbon functional group $R^2$ having 1 to 30 carbon atoms, where n represents values of between 1 and 90, preferably values of between 10 and 80, and in particular values of between 20 and 60. Surfactants of the above formula are particularly preferred in which $R^1$ represents $C_7$ to $C_{13}$, n represents a whole natural number from 16 to 28, and $R^2$ represents $C_8$ to $C_{12}$.

Surfactants of formula $R^1O[CH_2CH(CH_3)O]_x[CH_2CH_2O]_yCH_2CH(OH)R^2$ are particularly preferred, in particular for cleaning agents for automatic dishwashing, in which $R^1$ represents a linear or branched aliphatic hydrocarbon functional group having 4 to 18 carbon atoms or mixtures thereof, $R^2$ represents a linear or branched hydrocarbon functional group having 2 to 26 carbon atoms or mixtures thereof, x represents values of between 0.5 and 1.5, and y represents a value of at least 15. The group of these non-ionic surfactants includes for example the $C_{2-26}$ fatty alcohol $(PO)_1$-$(EO)_{15-40}$-2-hydroxyalkyl ethers, in particular including the $C_{8-10}$ fatty alcohol $(PO)_1$-$(EO)_{22}$-2-hydroxydecyl ethers.

In particular, those end-capped poly(oxyalkylated) non-ionic surfactants, in particular for cleaning agents for automatic dishwashing, are preferred which are of the formula $R^1O[CH_2CH_2O]_x[CH_2CH(R^3)O]_yCH_2CH(OH)R^2$, in which $R^1$ and $R^2$ represent, independently of one another, a linear or branched, saturated or mono- or polyunsaturated hydrocarbon functional group having 2 to 26 carbon atoms, $R^3$ is selected, independently of one another, from $—CH_3$, $—CH_2CH_3$, $—CH_2CH_2—CH_3$, $—CH(CH_3)_2$, but preferably represents $—CH_3$, and x and y represent, independently of one another, values of between 1 and 32, with non-ionic surfactants where $R^3$=$—CH_3$ and having values for x of from 15 to 32 and for y of from 0.5 and 1.5 being very particularly preferred.

Further preferably used non-ionic surfactants, in particular for cleaning agents for automatic dishwashing, are the end-capped poly(oxyalkylated) non-ionic surfactants of the formula $R^1O[CH_2CH(R^3)O]_x[CH_2]_kCH(OH)[CH_2]_jOR^2$, in which $R^1$ and $R^2$ represent linear or branched, saturated or unsaturated, aliphatic or aromatic hydrocarbon functional groups having 1 to 30 carbon atoms, $R^3$ represents H or a methyl, ethyl, n-propyl, iso-propyl, n-butyl, 2-butyl or 2-methyl-2-butyl functional group, x represents values between 1 and 30, and k and j represent values between 1 and 12, preferably between 1 and 5. If the value x is >2, each $R^3$ in the above formula $R^1O[CH_2CH(R^3)O]_x[CH_2]_kCH(OH)[CH_2]_jOR^2$ can be different. $R^1$ and $R^2$ are preferably linear or branched, saturated or unsaturated, aliphatic or aromatic hydrocarbon functional groups having 6 to 22 carbon atoms, with functional groups having 8 to 18 C atoms being particularly preferred. For the functional group $R^3$, H, $—CH_3$ or $—CH_2CH_3$ are particularly preferred. Particularly preferred values for x are in the range of from 1 to 20, in particular from 6 to 15.

As described above, each $R^3$ in the above formula can be different if x>2. In this way, the alkylene oxide unit in square brackets can be varied. For example, if x represents 3, the functional group $R^3$ can be selected in order to form ethylene oxide ($R^3$=H) or propylene oxide ($R^3$=$CH_3$) units, which can be joined together in any sequence, for example (EO)(PO)(EO), (EO)(EO)(PO), (EO)(EO)(EO), (PO)(EO)(PO), (PO)(PO)(EO) and (PO)(PO)(PO). The value 3 for x has been selected here by way of example and can by all means be greater, in which case the range of variation increases as the values for x increase and includes a large number of (EO) groups combined with a small number of (PO) groups, for example, or vice versa.

Particularly preferred end-capped poly(oxyalkylated) alcohols of the above formula have values of k=1 and j=1, such that the previous formula is simplified to $R^1O[CH_2CH(R^3)O]_xCH_2CH(OH)CH_2OR^2$. In the formula mentioned last, $R^1$, $R^2$ and $R^3$ are as defined above and x represents numbers from 1 to 30, preferably from 1 to 20, and in particular from 6 to 18. Surfactants in which the functional groups $R^1$ and $R^2$ have 9 to 14 C atoms, $R^3$ represents H, and x assumes values from 6 to 15 are particularly preferred. Finally, the non-ionic surfactants of the general formula $R^1—CH(OH)CH_2O-(AO)_w—R^2$ have proven to be particularly effective, in which

- $R^1$ represents a straight-chain or branched, saturated or mono- or polyunsaturated $C_{6-24}$ alkyl or alkenyl functional group;
- $R^2$ represents a linear or branched hydrocarbon functional group having 2 to 26 carbon atoms;
- A represents a functional group from the group $CH_2CH_2$, $CH_2CH_2CH_2$, $CH_2CH(CH_3)$, preferably $CH_2CH_2$, and
- w represents values between 1 and 120, preferably 10 to 80, particularly 20 to 40.

The group of these non-ionic surfactants includes, for example, the $C_{4-22}$ fatty alcohol-$(EO)_{10-80}$-2-hydroxyalkyl ethers, in particular including the $C_{8-12}$ fatty alcohol-$(EO)_{22}$-2-hydroxydecyl ethers and the $C_{4-22}$ fatty alcohol-$(EO)_{40-80}$-2-hydroxyalkyl ethers.

Furthermore, the agent may contain, as a non-ionic surfactant, amine oxide. In principle, all the amine oxides found in the prior art for this purpose, i.e. compounds that have the formula $R^1R_2R^3NO$, where each of $R^1$, $R^2$ and $R^3$ are, independently of one another, an optionally substituted hydrocarbon chain having 1 to 30 carbon atoms, can be used as the amine oxide. Amine oxides that are particularly preferably used are those in which $R^1$ is an alkyl having 12 to 18 carbon atoms and $R^2$ and $R^3$ are, independently of one another, an alkyl having 1 to 4 carbon atoms, in particular alkyl dimethyl amine oxides having 12 to 18 carbon atoms. Example representatives of suitable amine oxides are N-coco alkyl-N,N-dimethyl amine oxide, N-tallow alkyl-N, N-dihydroxyethyl amine oxide, myristyl/cetyl dimethyl amine oxide or lauryl dimethyl amine oxide.

Suitable non-ionic surfactants include alkyl glycosides of general formula $RO(G)_x$, for example, in which R corresponds to a primary straight-chain or methyl-branched aliphatic functional group, in particular an aliphatic functional group that is methyl-branched in the 2 position, having 8 to 22, preferably 12 to 18, C atoms, and G is the symbol that represents a glycose unit having 5 or 6 C atoms, preferably glucose. The degree of oligomerization x, which indicates the distribution of monoglycosides and oligoglycosides, is any number between 1 and 10; x is preferably between 1.2 and 1.4.

Another class of preferably used non-ionic surfactants, which are used either as the sole non-ionic surfactant or in combination with other non-ionic surfactants, are alkoxylated, preferably ethoxylated or ethoxylated and propoxylated fatty acid alkyl esters, preferably having 1 to 4 carbon atoms in the alkyl chain.

Other suitable surfactants are the polyhydroxy fatty acid amides, which are known as PHFAs.

Other non-ionic surfactants that can be used may be, for example,

- polyol fatty acid esters,
- alkoxylated triglycerides,
- alkoxylated fatty acid alkyl esters of formula $R^3CO—(OCH_2CHR^4)_wOR^5$, in which $R^3CO$ represents a linear or branched, saturated and/or unsaturated acyl functional group having 6 to 22 carbon atoms, $R^4$ represents hydrogen or methyl, and $R^5$ represents linear or branched alkyl functional groups having 1 to 4 carbon atoms, and w is 1 to 20,
- hydroxy mixed ethers,
- sorbitan fatty acid esters and addition products of ethylene oxide to sorbitan fatty acid esters such as the polysorbates,
- sugar fatty acid esters and addition products of ethylene oxide to sugar fatty acid esters,
- addition products of ethylene oxide to fatty acid alkanolamides and fatty amines,
- fatty acid-N-alkyl glucamides.

The agents described herein of the portion according to the invention may also contain several of the non-ionic surfactants described above.

In a further preferred embodiment, the agent of the portion according to the invention additionally contains at least one soil-release active ingredient. Substances which allow the removal of dirt are often referred to as soil-release active ingredients or as soil repellents since they are capable of making the treated surface, preferably textiles, repellant to soil. Owing to their chemical similarity to polyester fibers, particularly effective active ingredients which allow the removal of dirt, but can also exhibit the desired effect on fabrics made of other materials, are copolyesters containing dicarboxylic acid units, alkylene glycol units and polyalkylene glycol units. Such polyesters which allow the removal of dirt and the use thereof, preferably in detergents for textiles, have long been known.

For example, polymers of ethylene terephthalate and polyethylene oxide terephthalate in which the polyethylene glycol units have molecular weights of from 750 to 5,000 and the molar ratio of ethylene terephthalate to polyethylene oxide terephthalate is from 50:50 to 90:10, and the use thereof in detergents are described in the German patent DE 28 57 292. Polymers that have a molecular weight of from 15,000 to 50,000 and consist of ethylene terephthalate and polyethylene oxide terephthalate in which the polyethylene glycol units have molecular weights of from 1,000 to 10,000 and the molar ratio of ethylene terephthalate to polyethylene oxide terephthalate is from 2:1 to 6:1 can be used in detergents according to the German laid-open application DE 33 24 258. European patent EP 066 944 relates to textile treatment agents containing a copolyester of ethylene glycol, polyethylene glycol, aromatic dicarboxylic acid and sulfonated aromatic dicarboxylic acid in certain molar ratios. European patent EP 185 427 discloses polyesters that are end-capped with methyl or ethyl groups and have ethylene and/or propylene terephthalate and polyethylene oxide terephthalate units, and detergents containing soil-release polymers of this kind. European patent EP 241 984 relates to a polyester which, in addition to oxyethylene groups and terephthalic acid units, also contains substituted ethylene units and glycerol units. European patent EP 241 985 discloses polyesters which, in addition to oxyethylene groups and terephthalic acid units, contain 1,2-propylene, 1,2-butylene and/or 3-methoxy-1,2-propylene groups and glycerol units, and which are end-capped with $C_1$ to $C_4$ alkyl groups. European patent EP 253 567 relates to soil-release polymers that have a molar mass of from 900 to 9,000 and consist of ethylene terephthalate and polyethylene oxide terephthalate, wherein the polyethylene glycol units have molecular weights of from 300 to 3,000 and the molar ratio of ethylene terephthalate to polyethylene oxide terephthalate is from 0.6 to 0.95. European patent application EP 272 033 discloses polyesters that are end-capped at least in portions with $C_1$-4 alkyl or acyl functional groups and that have polypropylene terephthalate and polyoxyethylene terephthalate units. European patent EP 274 907 describes sulfoethyl-end-capped soil-release polyesters containing terephthalate. In European patent application EP 357 280, soil-release polyesters having terephthalate, alkylene glycol and poly-$C_{2-4}$ glycol units are produced by sulfonation of unsaturated end groups.

In a preferred embodiment of the invention, the agent of the portion according to the invention contains at least one polyester which allows the removal of dirt and contains the structural units E-I to E-III or E-I to E-IV,

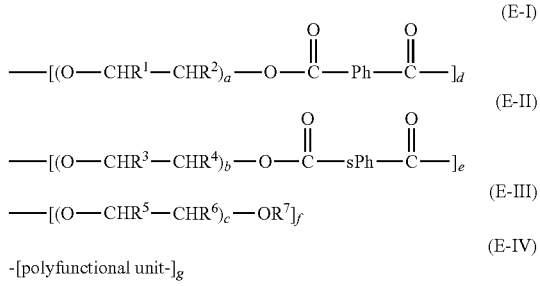

(E-I)

(E-II)

(E-III)

(E-IV)

in which a, b and c each represent, independently of one another, a number from 1 to 200, d, e and f each represent, independently of one another, a number from 1 to 50, g represents a number from 0 to 5, Ph is a 1,4-phenylene functional group, sPh represents a 1,3-phenylene functional group substituted with a ~$SO_3M$ group in position 5, M represents Li, Na, K, Mg/2, Ca/2, Al/3, ammonium, mono-, di-, tri- or tetraalkylammonium, the alkyl function groups of the ammonium ions being $C_1$-$C_{22}$ alkyl functional groups or $C_2$-$C_{10}$ hydroxyalkyl functional groups or any desired mixtures thereof, $R^1$, $R^2$, $R^3$, $R^4$, $R^5$ und $R^6$ each represent, independently of one another, hydrogen or a $C_1$-$C_{18}$ n- or iso-alkyl group, $R^7$ represents a linear or branched $C_1$-$C_{30}$ alkyl group or a linear or branched $C_2$-$C_{30}$ alkenyl group, a cycloalkyl group having 5 to 9 carbon atoms, a $C_6$-$C_{30}$ aryl group or a $C_6$-$C_{30}$ arylalkyl group, and Polyfunctional unit represents a unit having 3 to 6 functional groups capable of esterification reaction.

Preference is given to those polyesters in which $R^1$, $R^2$, $R^3$, $R^4$, $R^5$ and $R^6$ are each, independently of one another, hydrogen or methyl, $R^7$ represents methyl, a, b and c are each, independently of one another, a number from 1 to 200, in particular 1 to 20, particularly preferably 1 to 5, very preferably a and b=1 and c can be a number from 2 to 10, d is a number between 1 and 25, in particular between 1 and 10, particularly preferably between 1 and 5, e is a number between 1 and 30, in particular between 2 and 15, particularly preferably between 3 and 10, and f is a number between 0.05 and 15, in particular between 0.1 and 10, and particularly preferably between 0.25 and 3. Polyesters of this kind can be obtained, for example, by polycondensation of terephthalic acid dialkyl ester, 5-sulfoisophthalic acid dialkyl ester, alkylene glycols, optionally polyalkylene glycols (where a, b and/or c>1) and polyalkylene glycols capped at one end (corresponding to unit E-III). It should be noted that, for numbers a, b, c>1, there is a polymer backbone and thus the coefficients can assume, as an average, any value within the specified interval. This value reflects the number-average molecular weight. An ester of terephthalic acid having one or more difunctional, aliphatic alcohols is considered as unit (E-I), with ethylene glycol ($R^1$ and $R^2$ each being H) and/or 1,2-propylene glycol ($R^1$=H and $R^2$=—$CH_3$ or vice versa) and/or shorter-chain polyethylene glycols and/or poly[ethylene glycol-co-propylene glycol] having number-average molecular weights of from 100 to 2,000 g/mol being preferably used. The structures can contain, for example, 1 to 50 units (E-I) per polymer chain. An ester of 5-sulfoisophthalic acid having one or more difunctional, aliphatic alcohols is considered as unit (E-II), with the above-mentioned esters preferably being used in this case. There can be, for example, 1 to 50 units (E-II) in the structures. Poly[ethylene glycol-co-propylene glycol] monomethyl ethers having average molecular weights of from 100 to 2,000 g/mol and polyethylene glycol monomethyl ethers of general formula $CH_3$—O—$(C_2H_4O)_n$—H where n=1 to 99, in particular 1 to 20 and particularly preferably 2 to 10, are preferably used as polyalkylene glycol monoalkyl ethers according to unit (E-III) that are non-ionically capped at one end. Since the theoretical maximum average molecular weight, to be achieved using quantitative conversion, of a polyester structure is specified by the use of such ethers that are capped at one end, the preferred use amount of structural unit (E-III) is that which is necessary for achieving the average molecular weights described below. With the exception of linear polyesters which result from structural units (E-I), (E-II) and (E-III), the use of crosslinked or branched polyester structures is also in accordance with the invention. This is expressed by the presence of a crosslinking polyfunctional structural unit (E-IV) having at least three to at most 6 functional groups capable of an esterification reaction. Acid, alcohol, ester, anhydride or epoxy groups, for example, can be named as functional groups in this case. Different functionalities in one molecule are also possible. Examples of this are citric acid, malic acid, tartaric acid and gallic acid, particularly preferably 2,2-dihydroxymethylpropionic acid. Polyhydric alcohols such as pentaerythrol, glycerol, sorbitol and/or trimethylolpropane can also be used. These may also be polyvalent aliphatic or aromatic carboxylic acids, such as benzene-1,2,3-tricarboxylic acid (hemimellitic acid), benzene-1,2,4-tricarboxylic acid (trimellitic acid), or benzene-1,3,5-tricarboxylic acid (trimesic acid). The weight proportion of crosslinking monomers, based on the total mass of the polyester, can be up to 10 wt. %, in particular up to 5 wt. %, and particularly preferably up to 3 wt. %, for example. The polyesters, containing the structural units (EI), (E-II) and (E-III) and optionally (E-IV), generally have number-average molecular weights in the range of from 700 to 50,000 g/mol, it being possible to determine the number-average molecular weight by means of size-exclusion chromatography in aqueous solution, using calibration with reference to closely distributed polyacrylic acid Na salt standards. Preferably, the number-average molecular weights are in the range of from 800 to 25,000 g/mol, in particular from 1,000 to 15,000 g/mol, particularly preferably from 1,200 to 12,000 g/mol. Preferably, solid polyesters having softening points above 40° C. are used according to the invention as a component of the particle of the second type; said polyesters preferably have a softening point of between 50 and 200° C., particularly preferably between 80° C. and 150° C., and extremely preferably between 100° C. and 120° C. The polyesters can be synthesized according to known methods, for example by the above-mentioned components first being heated at normal pressure by adding a catalyst and then forming the required molecular weights in the vacuum by hyperstoichiometric amounts of the glycols used being distilled off. The known transesterification and condensation catalysts, such as titanium tetraisopropylate, dibutyltin oxide, alkaline or alkaline earth metal alcoholates, or antimony trioxide/calcium acetate, are suitable for the reaction. Reference is made to EP 442 101 for further details.

The agent of the portion according to the invention can additionally contain at least one enzyme. In principle, all the enzymes found in the prior art for textile treatment can be used in this regard. This at least one enzyme is preferably one or more enzymes which can develop catalytic activity in a surfactant-containing liquor, in particular a protease, amylase, lipase, cellulase, hemicellulase, mannanase, pectin-cleaving enzyme, tannase, xylanase, xanthanase, β-glucosidase, carrageenanase, perhydrolase, oxidase, oxidoreductase and mixtures thereof. Preferred hydrolytic enzymes include in particular proteases, amylases, in particular α-amylases, cellulases, lipases, hemicellulases, in particular pectinases, mannanases, β-glucanases, and mixtures thereof. Proteases, amylases and/or lipases and mixtures thereof are particularly preferred, and proteases are very particularly preferred. These enzymes are in principle of natural origin; starting from the natural molecules, variants that have been improved for use in detergents or cleaning agents are available, which are preferably used accordingly.

Among the proteases, the subtilisin-type proteases are preferred. Examples of these are the subtilisins BPN' and Carlsberg, protease PB92, subtilisins 147 and 309, the alkaline protease from *Bacillus lentus*, subtilisin DY, and the enzymes thermitase, proteinase K and proteases TW3 and TW7, which belong to the subtilases but no longer to the subtilisins in the narrower sense. Subtilisin Carlsberg is available in a developed form under the trade name Alcalase® from Novozymes A/S, Bagsvaerd, Denmark. Subtilisins 147 and 309 are marketed by Novozymes under the trade names Esperase® and Savinase®, respectively. The protease variants marketed under the name BLAP® are derived from the protease from *Bacillus lentus* DSM 5483. Other proteases that can be used are, for example, the enzymes available under the trade names Durazym®, Relase®, Everlase®, Nafizym®, Natalase®, Kannase® and Ovozyme® from Novozymes, the enzymes available under the trade names Purafect®, Purafect® OxP, Purafect® Prime, Excellase® and Properase® from Genencor, the enzyme available under the trade name Protosol® from Advanced Biochemicals Ltd., Thane, India, the enzyme available under the trade name Wuxi® from Wuxi Snyder Bioproducts Ltd., China, the enzymes available under the trade names Proleather® and Protease P® from Amano Pharmaceuticals Ltd., Nagoya, Japan, and the enzyme available under the name Proteinase K-16 from Kao Corp., Tokyo, Japan. The proteases from *Bacillus gibsonii* and *Bacillus pumilus* are particularly preferably used.

Examples of amylases that can be used according to the invention are α-amylases from *Bacillus licheniformis*, from *B. amyloliquefaciens* or from *B. stearothermophilus*, as well as the developments thereof that have been improved for use in detergent or cleaning agents. The enzyme from *B. licheniformis* is available from Novozymes under the name Termamyl® and from Genencor under the name Purastar®ST. Development products of this α-amylase are available from Novozymes under the trade names Duramyl® and Termamyl®ultra, from Genencor under the name Purastar®OxAm, and from Daiwa Seiko Inc., Tokyo, Japan, as Keistase®. The α-amylase from *B. amyloliquefaciens* is marketed by Novozymes under the name BAN®, and derived variants from the α-amylase from *B. stearothermophilus* are marketed under the names BSG® and Novamyl®, also by Novozymes. Others that are particularly noteworthy for this purpose are α-amylase from *Bacillus* sp. A 7-7 (DSM 12368) and cyclodextrin glucanotransferase (CGTase) from *B. agaradherens* (DSM 9948). Fusion products of all mentioned molecules can also be used. Furthermore, the developments of the α-amylase from *Aspergillus niger* and *A. oryzae*, available under the trade name Fungamyl® from Novozymes, are suitable. Other commercial products that can advantageously be used are, for example, Amylase-LT®, and Stainzyme® or Stainzyme Ultra® or Stainzyme Plus®, the latter also from Novozymes. Variants of these enzymes that can be obtained by point mutations may also be used according to the invention.

Examples of lipases or cutinases that can be used according to the invention, which are contained in particular due to their triglyceride-cleaving activities, but also in order to produce peracids in situ from suitable precursors, are the lipases that can be originally obtained or developed from *Humicola lanuginosa* (*Thermomyces lanuginosis*), in particular those with the amino acid exchange D96L. These are marketed for example by Novozymes under the trade names Lipolase®, Lipolase®Ultra, LipoPrime®, Lipozyme® and Lipex®. Furthermore, the cutinases that have been isolated originally from *Fusarium solani pisi* and *Humicola insolens* can be used, for example. Lipases that can also be used are available from Amano under the names Lipase CE®, Lipase P®, Lipase B®, and Lipase CES®, Lipase AKG®, *Bacillus* sp. Lipase®, Lipase AP®, Lipase M-AP® and Lipase AML®. From Genencor, the lipases or cutinases of which the starting enzymes have been isolated originally from *Pseudomonas mendocina* and *Fusarium solanii* can be used, for example. The preparations M1 Lipase® and Lipomax® originally marketed by Gist-Brocades, the enzymes marketed by Meito Sangyo KK, Japan, under the names Lipase MY-30®, Lipase OF® and Lipase PL®, and the product Lumafast® from Genencor should be mentioned as other important commercial products.

Depending on their purpose, cellulases can be present as pure enzymes, as enzyme preparations or in the form of mixtures in which the individual components are advantageously complementary in terms of their different performance aspects, in particular in portions for textile washing. These performance aspects include in particular the contributions of the cellulase to the primary washing performance of the agent (cleaning performance), to the secondary washing performance of the agent (anti-redeposition effect or graying inhibition), to softening (fabric effect), or to providing a "stone-washed" effect. A usable fungal cellulase preparation that is rich in endoglucanase (EG) and the developments thereof are provided by Novozymes under the trade name Celluzyme®. The products Endolase® and Carezyme® also available from Novozymes are based on 50 kD-EG and 43 kD-EG, respectively, from *H. insolens* DSM 1800. Other commercial products from this company that can be used are Cellusoft®, Renozyme® and Celluclean®. It is also possible to use the cellulase 20 kD-EG from *Melanocarpus*, which is available from AB Enzymes, Finland, under the trade names Ecostone® and Biotouch®. Other commercial products from AB Enzymes are Econase® and Ecopulp®. Other suitable cellulases are from *Bacillus* sp. CBS 670.93 and CBS 669.93, the cellulase from *Bacillus* sp. CBS 670.93 being available from Genencor under the trade name Puradax®. Other commercial products from Genencor are "Genencor detergent cellulase L" and IndiAge®Neutra. Variants of these enzymes that can be obtained by point mutations may also be used according to the invention. Particularly preferred cellulases are *Thielavia terrestris* cellulase variants, cellulases from *Melanocarpus*, in particular *Melanocarpus albomyces*, EGIII-type cellulases from *Trichoderma reesei*, or variants that can be obtained therefrom.

Furthermore, other enzymes which can be grouped together under the term "hemicellulases" can be used in particular to remove specific problematic stains on the substrate. These include, for example, mannanases, xanthan lyases, xanthanases, xyloglucanases, xylanases, pullulanases, pectin-cleaving enzymes, and β-glucanases. The β-glucanase obtained from *Bacillus subtilis* is available from Novozymes under the name Cereflo®. Hemicellulases that are particularly preferred according to the invention are mannanases which are marketed, for example, under the trade names Mannaway® by Novozymes or Purabrite® by Genencor. In the context of the present invention, the pectin-cleaving enzymes also include enzymes having the names pectinase, pectate lyase, pectin esterase, pectin demethoxylase, pectin methoxylase, pectin methylesterase, pectase, pectin methylesterase, pectinesterase, pectin pectyl hydrolase, pectin depolymerase, endopolygalacturonase, pectolase, pectin hydrolase, pectin polygalacturonase, endopolygalacturonase, poly-α-1,4-galacturonide, glycanohydrolase, endogalacturonase, endo-D-galacturonase, galacturan 1,4-α-galacturonidase, exopolygalacturonase, poly (galacturonate) hydrolase, exo-D-galacturonase, exo-D-galacturonanase, exopoly-D-galacturonase, exo-poly-α-galacturonosidase, exopolygalacturonosidase, or exopolygalacturanosidase. Examples of enzymes that are suitable in this regard are available for example under the names Gamanase®, Pektinex AR®, X-Pect® or Pectaway® from Novozymes, under the names Rohapect UF®, Rohapect TPL®, Rohapect PTE100®, Rohapect MPE®, Rohapect MA plus HC, Rohapect DA12L®, Rohapect 10L®, Rohapect B1L® from AB Enzymes, and under the name Pyrolase® from Diversa Corp., San Diego, Calif., USA.

Of all these enzymes, particularly preferred are those which have been stabilized in a comparatively stable manner against oxidation or by means of point mutagenesis, for example. This includes in particular the above-mentioned commercial products Everlase® and Purafect®OxP as examples of proteases of this kind and Duramyl® as an example of an α-amylase of this kind.

The agent of the portion according to the invention contains enzymes preferably in total amounts of from $1\times10^{-8}$ to 5 wt. % based on active protein. Preferably, the enzymes are contained in this portion in a total amount of from 0.001 to 2 wt. %, more preferably from 0.01 to 1.5 wt. %, even more preferably from 0.05 to 1.25 wt. %, and particularly preferably from 0.01 to 0.5 wt. %.

Moreover, builders, complexing agents, optical brighteners (preferably in portions for textile washing), pH adjusters, perfume, dye, dye transfer inhibitors, bleaching agents, or mixtures thereof, can be contained in the agent of the portion as additional ingredients.

The use of builder substances (builders) such as silicates, aluminum silicates (in particular zeolites), salts of organic di- and polycarboxylic acids, as well as mixtures of these substances, preferably water-soluble builder substances, can be advantageous.

In an embodiment that is preferred according to the invention, the use of phosphates (including polyphosphates) is omitted either largely or completely. In this embodiment, the agent preferably contains less than 5 wt. %, particularly preferably less than 3 wt. %, in particular less than 1 wt. % phosphate(s). Particularly preferably, the agent in this embodiment is completely phosphate-free, i.e. the agents contain less than 0.1 wt. % phosphate(s).

The builders include, in particular, carbonates, citrates, phosphonates, organic builders, and silicates. The proportion by weight of the total builders with respect to the total weight of agents according to the invention is preferably 15 to 80 wt. % and in particular 20 to 70 wt. %.

Some examples of organic builders that are suitable according to the invention are the polycarboxylic acids (polycarboxylates) that can be used in the form of their sodium salts, with polycarboxylic acids being understood as being those carboxylic acids that carry more than one, in particular two to eight acid functions, preferably two to six, in particular two, three, four, or five acid functions in the entire molecule. As polycarboxylic acids, dicarboxylic acids, tricarboxylic acids, tetracarboxylic acids, and pentacarboxylic acids, in particular di-, tri-, and tetracarboxylic acids, are thus preferred. The polycarboxylic acids can also carry additional functional groups such as hydroxyl or amino groups, for example. For example, these include citric acid, adipic acid, succinic acid, glutaric acid, malic acid, tartaric acid, maleic acid, fumaric acid, sugar acids (preferably aldaric acids, for example galactaric acid and glucaric acid), aminocarboxylic acids, in particular aminodicarboxylic acids, aminotricarboxylic acids, aminotetracarboxylic acids such as, for example, nitrilotriacetic acid (NTA), glutamic-N,N-diacetic acid (also called N,N-bis(carboxymethyl)-L-glutamic acid or GLDA), methyl glycine diacetic acid (MGDA) and derivatives thereof and mixtures thereof. Preferred salts are the salts of the polycarboxylic acids such as citric acid, adipic acid, succinic acid, glutaric acid, tartaric acid, GLDA, MGDA, and mixtures thereof.

Other substances that are suitable as organic builders are polymeric polycarboxylates (organic polymers with a plurality of (in particular greater than ten) carboxylate functions in the macromolecule), polyaspartates, polyacetals, and dextrins.

Besides their building effect, the free acids also typically have the quality of an acidifying component. Particularly noteworthy here are citric acid, succinic acid, glutaric acid, adipic acid, gluconic acid, and any mixtures thereof.

Particularly preferred agents of the portion according to the invention, in particular dishwashing detergents, preferably automatic dishwashing detergents, contain one or more salts of citric acid, i.e. citrates, as one of their essential builders. These are preferably contained in a proportion of from 2 to 40 wt. %, in particular from 5 to 30 wt. %, more particularly from 7 to 28 wt. %, particularly preferably from 10 to 25 wt. %, very particularly preferably from 15 to 20 wt. %, in each case based on the total weight of the agent.

It is also particularly preferred to use carbonate(s) and/or hydrogen carbonate(s), preferably alkali carbonate(s), particularly preferably sodium carbonate (soda), in amounts of from 2 to 50 wt. %, preferably from 4 to 40 wt. %, and in particular from 10 to 30 wt. %, very particularly preferably from 10 to 24 wt. %, in each case based on the weight of the agent.

Particularly preferred agents of the portion according to the invention, in particular dishwashing detergents, preferably automatic dishwashing detergents, are characterized in that they contain at least two builders from the group of silicates, phosphonates, carbonates, aminocarboxylic acids, and citrates, with the proportion by weight of these builders based on the total weight of the cleaning agent according to the invention being preferably 5 to 70 wt. %, more preferably 15 to 60 wt. %, and in particular 20 to 50 wt. %. The combination of two or more builders from the above-mentioned group has proven advantageous for the cleaning and rinsing performance of detergents or cleaning agents according to the invention, in particular dishwashing detergents, preferably automatic dishwashing detergents. Beyond the builders mentioned here, one or more other builders can be additionally contained.

Preferred agents of the portion according to the invention, in particular dishwashing detergents, preferably automatic dishwashing detergents, are characterized by a builder combination of citrate and carbonate and/or hydrogen carbonate. In one embodiment that is very particularly preferred according to the invention, a mixture of carbonate and citrate is used in which the amount of carbonate is preferably from 5 to 40 wt. %, in particular from 10 to 35 wt. %, very particularly preferably from 15 to 30 wt. %, and the amount of citrate is preferably from 5 to 35 wt. %, in particular from 10 to 25 wt. %, very particularly preferably from 15 to 20 wt. %, in each case based on the total amount of the cleaning agent, with the total amount of these two builders preferably being from 20 to 65 wt. %, in particular from 25 to 60 wt. %, preferably from 30 to 50 wt. %. Moreover, one or more other builders can be additionally contained.

The detergents or cleaning agents according to the invention, in particular dishwashing detergents, preferably automatic dishwashing detergents, can contain phosphonates in particular as an additional builder. A hydroxy alkane and/or amino alkane phosphonate is preferably used as a phosphonate compound. Among the hydroxy alkane phosphonates, 1-hydroxyethane-1,1-diphosphonate (HEDP) has particular significance. Possible preferable aminoalkane phosphonates include ethylenediamine tetramethylene phosphonate (EDTMP), diethylentriamine pentamethylene phosphonate (DTPMP) and the higher homologues thereof. Phosphonates are preferably contained in the agents according to the invention in amounts of from 0.1 to 10 wt. %, in particular in amounts of from 0.5 to 8 wt. %, very particularly preferably from 2.5 to 7.5 wt. %, in each case based on the total weight of the agent.

The combined use of citrate, (hydrogen) carbonate, and phosphonate is particularly preferred. These can be used in the above-mentioned amounts. In particular, amounts of 10 to 25 wt. % citrate, 10 to 30 wt. % carbonate (or hydrogen carbonate), and 2.5 to 7.5 wt. % phosphonate are used in this combination, in each case based on the total weight of the agent.

Additional particularly preferred detergents or cleaning agents, in particular dishwashing detergents, preferably automatic dishwashing detergents, are characterized in that, in addition to citrate and (hydrogen) carbonate and, optionally, phosphonate, they contain at least one additional phosphorus-free builder. In particular, it is selected from aminocarboxylic acids, with the additional phosphorus-free builder preferably being selected from methyl glycine diacetic acid (MGDA), glutamic acid diacetate (GLDA), aspartic acid diacetate (ASDA), hydroxyethyliminodiacetate (HEIDA), iminodisuccinate (IDS), and ethylenediamine disuccinate (EDDS), particularly preferably from MGDA or GLDA. An example of a particularly preferred combination is citrate, (hydrogen) carbonate, and MGDA as well as, optionally, phosphonate.

The proportion by weight of the additional phosphorus-free builder, in particular of the MGDA and/or GLDA, is preferably from 0 to 40 wt. %, in particular from 5 to 30 wt. %, more particularly from 7 to 25 wt. %. The use of MGDA or GLDA, in particular MGDA, as granular material is particularly preferred. Advantageous in this regard are MGDA granules that contain as little water as possible and/or have a lower hygroscopicity (water absorption at 25° C., normal pressure) than non-granulated powders. The combination of at least three, in particular at least four, builders from the above-mentioned group has proven advantageous for the cleaning and rinsing performance of cleaning agents according to the invention, in particular dishwashing detergents, preferably automatic dishwashing detergents. Besides those, additional builders can also be contained.

Polymeric polycarboxylates are also suitable as organic builders. These are, for example, the alkali metal salts of polyacrylic acid or polymethacrylic acid, for example those having a relative molecular mass of from 500 to 70,000 g/mol. Suitable polymers are in particular polyacrylates which preferably have a molecular mass of from 1,000 to 20,000 g/mol. Due to their superior solubility, the short-chain polyacrylates, which have molar masses of from 1,100 to 10,000 g/mol, and particularly preferably from 1,200 to 5,000 g/mol, can be preferred from this group.

The (homo)polymeric polycarboxylates contained in the detergent or cleaning agents according to the invention, in particular dishwashing detergent, preferably automatic dishwashing detergent, amount to preferably from 0.5 to 20 wt. %, more preferably from 2 to 15 wt. %, and in particular from 4 to 10 wt. %.

Detergents or cleaning agents according to the invention, in particular dishwashing detergents, preferably automatic dishwashing detergents, can also contain, as a builder, crystalline layered silicates of general formula $NaMSi_xO_2x+1'y\ H_2O$, where M represents sodium or hydrogen, x is a number from 1.9 to 22, preferably from 1.9 to 4, with 2, 3, or 4 being particularly preferred values for x, and y represents a number from 0 to 33, preferably from 0 to 20. Amorphous sodium silicates with an $Na_2O:SiO_2$ modulus of 1:2 to 1:3.3, preferably 1:2 to 1:2.8, and in particular 1:2 to 1:2.6 can also be used which preferably have retarded dissolution and secondary washing properties.

In certain detergents or cleaning agents according to the invention, in particular dishwashing detergents, preferably automatic dishwashing detergents, the silicate content, based on the total weight of the detergent or cleaning agent, is limited to amounts below 10 wt. %, preferably below 5 wt. %, and in particular below 2 wt. %.

An optical brightener is preferably selected from the substance classes of distyrylbiphenyls, stilbenes, 4,4'-diamino-2,2'-stilbene disulfonic acids, coumarins, dihydroquinolones, 1,3-diarylpyrazolines, naphthalic acid imides, benzoxazole systems, benzisoxazole systems, benzimidazole systems, pyrene derivatives substituted with heterocycles, and mixtures thereof.

Particularly preferred optical brighteners include disodium-4,4'-bis-(2-morpholino-4-anilino-s-triazin-6-ylamino) stilbene disulfonate (for example available as Tinopal® DMS from BASF SE), disodium-2,2'-bis-(phenyl-styryl) disulfonate (for example available as Tinopal® CBS from BASF SE), 4,4'-bis[(4-anilino-6-[bis(2-hydroxyethyl) amino]-1,3,5-triazin-2-yl)amino]stilbene-2,2'-disulfonic acid (for example available as Tinopal® UNPA from BASF SE), hexasodium-2,2'-[vinylenebis[(3-sulfonato-4,1-phenylene)imino[6-(diethylamino)-1,3,5-triazin-4,2-diyl] imino]]bis-(benzene-1,4-disulfonate) (for example available as Tinopal® SFP from BASF SE), 2,2'-(2,5-thiophendiyl) bis[5-1,1-dimethylethyl)-benzoxazole (for example available as Tinopal® SFP from BASF SE) and/or 2,5-bis(benzoxazol-2-yl)thiophene.

It is preferable for the dye transfer inhibitor to be a polymer or a copolymer of cyclic amines such as vinylpyrrolidone and/or vinylimidazole. Polymers suitable as a dye transfer inhibitor include polyvinylpyrrolidone (PVP), polyvinylimidazole (PVI), copolymers of vinylpyrrolidone and vinylimidazole (PVP/PVI), polyvinylpyridine-N-oxide, poly-N-carboxymethyl-4-vinylpyridium chloride, polyethylene glycol-modified copolymers of vinylpyrrolidone and vinylimidazole, and mixtures thereof. Particularly preferably, polyvinylpyrrolidone (PVP), polyvinylimidazole (PVI) or copolymers of vinylpyrrolidone and vinylimidazole (PVP/PVI) are used as a dye transfer inhibitor. The polyvinylpyrrolidones (PVP) used preferably have an average molecular weight of 2,500 to 400,000 and are commercially available from ISP Chemicals as PVP K 15, PVP K 30, PVP K 60 or PVP K 90, or from BASF as Sokalan® HP 50 or Sokalan® HP 53. The copolymers of vinylpyrrolidone and vinylimidazole (PVP/PVI) used preferably have a molecular weight in the range of from 5,000 to 100,000. A PVP/PVI copolymer is commercially available from BASF under the name Sokalan® HP 56, for example. Other dye transfer inhibitors that can be extremely preferably used are polyethylene glycol-modified copolymers of vinylpyrrolidone and vinylimidazole, which for example are available from BASF under the name Sokalan® HP 66.

In a preferred embodiment, agents of the portion according to the invention, in particular dishwashing detergents, contain, as an additional component, at least one zinc salt as a glass corrosion inhibitor. The zinc salt can be an inorganic or organic zinc salt. The zinc salt to be used according to the invention preferably has a solubility in water of greater than 100 mg/l, preferably greater than 500 mg/l, particularly preferably greater than 1 g/l, and in particular greater than 5 g/l (all solubilities at 20° C. water temperature). The inorganic zinc salt is preferably selected from the group consisting of zinc bromide, zinc chloride, zinc iodide, zinc nitrate, and zinc sulfate. The organic zinc salt is preferably selected from the group consisting of zinc salts of monomeric or polymeric organic acids, particularly from the group of zinc acetate, zinc acetyl acetonate, zinc benzoate, zinc formate, zinc lactate, zinc gluconate, zinc ricinoleate, zinc abietate, zinc valerate, and zinc-p-toluene sulfonate. In an embodiment that is particularly preferred according to the invention, zinc acetate is used as a zinc salt. The zinc salt is preferably contained in cleaning agents according to the invention in an amount of from 0.01 wt. % to 5 wt. %, particularly preferably in an amount of from 0.05 wt. % to 3 wt. %, in particular in an amount of from 0.1 wt. % to 2 wt. %, based on the total weight of the cleaning agent. In addition or alternatively to the above-mentioned salts (in particular the zinc salts), polyethyleneimines such as those which are available under the name Lupasol® (BASF) are preferably used as glass corrosion inhibitors in an amount of from 0 to 5 wt. %, in particular from 0.01 to 2 wt. %.

All of the abovementioned ingredients of the agent produced in the portion according to the invention may be present in the first phase and/or in the second phase and/or in a further phase.

Hereinafter, preferred embodiments of the composition of the viscoelastic and solid shaped body of the second phase are described.

The viscoelastic and solid shaped body of the second phase necessarily contains, based on the total amount of the second composition, a total amount of more than 1 wt. % of the above-mentioned benzylidene alditol. Due to the stereochemistry of the alditols, it should be mentioned that benzylidene alditols according to the invention and as described above are suitable in the L configuration or in the D configuration or a mixture of the two. Due to natural availability, the benzylidene alditol compounds are preferably used according to the invention in the D configuration. It has been found to be preferable for the alditol backbone of the benzylidene alditol compound according to formula (I) contained in the second composition to be derived from D-glucitol, D-mannitol, D-arabinitol, D-ribitol, D-xylitol, L-glucitol, L-mannitol, L-arabinitol, L-ribitol, or L-xylitol.

Particularly preferred are those portions which are characterized in that $R^1$, $R^2$, $R^3$, $R^4$, $R^5$ and $R^6$ according to the benzylidene alditol compound of formula (I) mean, independently of one another, a hydrogen atom, methyl, ethyl, chlorine, fluorine, or methoxy, preferably a hydrogen atom.

n according to benzylidene alditol compound of formula (I) preferably represents 1.

m according to benzylidene alditol compound formula (I) preferably represents 1.

Very particularly preferably, the second composition of the portion contains, as a benzylidene alditol compound of formula (I), at least one compound of formula (I-1)

(I-1)

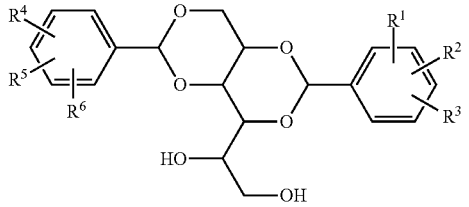

where $R^1$, $R^2$, $R^3$, $R^4$, $R^5$ and $R^6$ are as defined in the appended claims. Most preferably, according to formula (I-1), $R^1$, $R^2$, $R^3$, $R^4$, $R^5$ and $R^6$ represent, independently of one another, a hydrogen atom, methyl, ethyl, chlorine, fluorine, or methoxy, preferably a hydrogen atom.

Most preferably, the benzylidene alditol compound of formula (I) is selected from 1,3:2,4-di-O-benzylidene-D-sorbitol; 1,3:2,4-di-O-(p-methylbenzylidene)-D-sorbitol; 1,3:2,4-di-O-(p-chlorobenzylidene)-D-sorbitol; 1,3:2,4-di-O-(2,4-dimethylbenzylidene)-D-sorbitol; 1,3:2,4-di-O-(p-ethylbenzylidene)-D-sorbitol; 1,3:2,4-di-O-(3,4-dimethylbenzylidene)-D-sorbitol, or mixtures thereof.

The benzylidene alditol compound of formula (I) contained in the second composition is contained, based on the total weight of the second composition, preferably in a total amount of more than 1.5 wt. %, in particular of more than 2.0 wt. %. Particularly preferably, the benzylidene alditol compound of formula (I) contained in the second composition is contained, based on the total weight of the second composition, in a total amount of more than 1.6 wt. %, or more than 1.7 wt. %, or more than 1.8 wt. %, or more than 1.9 wt. %, or more than 2.0 wt. %, or more than 2.1 wt. %, or more than 2.2 wt. %, or more than 2.3 wt. %, or more than 2.4 wt. %, or more than 2.5 wt. %.

The benzylidene alditol compound of formula (I-1) contained in the second composition is contained, based on the total weight of the second composition, preferably in a total amount of more than 1.5 wt. %, in particular of more than 2.0 wt. %. Particularly preferably, the benzylidene alditol compound of formula (I-1) contained in the second composition is contained, based on the total weight of the second composition, in a total amount of more than 1.6 wt. %, or more than 1.7 wt. %, or more than 1.8 wt. %, or more than 1.9 wt. %, or more than 2.0 wt. %, or more than 2.1 wt. %, or more than 2.2 wt. %, or more than 2.3 wt. %, or more than 2.4 wt. %, or more than 2.5 wt. %.

In addition to the lower limit of amount according to the invention (or the preferred lower limits of amount thereof) of the above-mentioned benzylidene alditol compound, it is expedient to use the benzylidene alditol compound of formula (I) contained in the second composition, based on the total weight of the second composition, preferably in a total amount of at most 15 wt. %, in particular at most 10 wt. %.

In addition to the lower limit of amount according to the invention (or the preferred lower limits of amount thereof) of the above-mentioned benzylidene alditol compound, it is expedient to use the benzylidene alditol compound of formula (I-1) contained in the second composition, based on the total weight of the second composition, preferably in a total amount of at most 15 wt. %, in particular at most 10 wt. %.

The second composition of the above-mentioned shaped body preferably contains water in a total amount of from 0 to 40 wt. %, particularly preferably from 0 to 25 wt. %, based on the total weight of the second composition. The proportion of water in the second composition of the above-mentioned shaped body is very particularly preferably 20 wt. % or less, more preferably 15 wt. % or less, even more preferably 12 wt. % or less, in particular between 11 and 4 wt. %. The specifications in wt. % refer to the total weight of the second composition.

The solubility of the above-mentioned shaped body, and the stability thereof, is improved if preferably the second composition additionally contains at least one organic solvent having at least one hydroxyl group, no amino group and having a molecular weight of at most 500 g/mol.

According to the invention, a solvent per se is liquid at 20° C.

This above-mentioned organic solvent is in turn preferably selected from ($C_2$-$C_8$) alkanols having at least one hydroxyl group (particularly preferably ($C_2$-$C_8$) alkanols having at least two hydroxyl groups; very particularly preferably selected from the group ethanol, ethylene glycol, 1,2-propanediol, glycerol, 1,3-propanediol, n-propanol, isopropanol, 1,1,1-trimethylolpropane, 2-methyl-1,3-propanediol, 2-hydroxymethyl-1,3-propanediol, or mixtures thereof), triethylene glycol, butyl diglycol, polyethylene glycols having a weight-average molar mass $M_w$ of at most 500 g/mol, glycerol carbonate, propylene carbonate, 1-methoxy-2-propanol, 3-methoxy-3-methyl-1-butanol, butyl lactate, 2-isobutyl-2-methyl-4-hydroxymethyl-1,3-dioxolane, 2,2-dimethyl-4-hydroxymethyl-1,3-dioxolane, dipropylene glycol, or mixtures thereof.

It is in turn particularly preferable for said organic solvent to be contained in a total amount of from 5 to 95 wt. %, in particular from 20 to 90 wt. %.

The second composition very particularly preferably contains, in addition, in each case based on the total weight of the second composition, from 20 to 90 wt. % of at least one organic solvent having at least one hydroxyl group, no amino group and having a molecular weight of at most 500 g/mol (preferably at least one organic solvent having at least two hydroxyl groups, no amino group and having a molecular weight of at most 500 g/mol, particularly preferably at least one ($C_2$-$C_8$) alkanediol)

and from 0 to 25 wt. % water.

Achieving the technical object can be further optimized by at least one polyalkylene oxide compound that has a weight-average molar mass $M_w$ of at least 4,000 g/mol, in particular at least 6,000 g/mol, more preferably at least 8,000 g/mol, being preferably additionally contained in the second composition.

In this case, it has been found to be preferable for said polyalkylene oxide compound to be selected from polyethylene oxide, ethylene oxide-propylene oxide copolymer, and mixtures thereof.

Very particularly preferably, polyethylene oxide having a weight-average molar mass $M_w$ of at least 4,000 g/mol, in particular at least 6,000 g/mol, more preferably at least 8,000 g/mol, is used as the polyalkylene oxide compound.

In particular the stability and the elasticity of the above-mentioned shaped body is further improved if the second composition additionally contains at least one polymeric polyol, in particular polyvinyl alcohol. According to the present invention, polymeric polyols have more than 3 hydroxyl groups. Suitable polymeric polyols preferably have an average molar mass of from 4,000 to 100,000 g/mol.

The second composition of the above-mentioned shaped body preferably contains, based on the total weight thereof, a total amount of from 1 to 30 wt. %, in particular from 2 to 20 wt. %, of the polymeric polyol.

Polyvinyl alcohols are thermoplastic materials that are manufactured as white to yellowish powders, usually by hydrolysis of polyvinyl acetate. Polyvinyl alcohol (PVOH) is resistant to almost all water-free organic solvents. Polyvinyl alcohols having an average molar mass of from 30,000 to 60,000 g/mol are preferred.

Preferred polyvinyl alcohols are those present as white-yellowish powders or granules having degrees of polymerization in the range of from approximately 100 to 2,500 (molar masses of from approximately 4,000 to 100,000 g/mol) and degrees of hydrolysis of 87-99 mol. % which accordingly also contain a residual content of acetyl groups.

In the context of the present invention, it is preferred for the at least one second phase to comprise a polyvinyl alcohol of which the degree of hydrolysis is preferably 70 to 100 mol. %, in particular 80 to 90 mol. %, particularly preferably 81 to 89 mol. %, and even more preferably 82 to 88 mol. %. In a preferred embodiment, the water-soluble packaging consists of at least 20 wt. %, particularly preferably at least 40 wt. %, very particularly preferably at least 60 wt. %, and in particular at least 80 wt. % of a polyvinyl alcohol of which the degree of hydrolysis is 70 to 100 mol. %, preferably 80 to 90 mol. %, particularly preferably 81 to 89 mol. %, and in particular 82 to 88 mol. %.

PVOH powders having the aforementioned properties and suitable for use in the at least one second phase are sold, for example, under the name Mowiol® or Poval® by Kuraray. Particularly suitable are the Poval® grades, in particular grades 3-83, 3-88 and 3-98 and Mowiol® 4-88 from Kuraray.

The water solubility of polyvinyl alcohol can be altered by post-treatment with aldehydes (acetalization) or ketones (ketalization). Particularly preferred and, due to their decidedly good solubility in cold water, particularly advantageous polyvinyl alcohols have been produced which can be acetalized or ketalized with the aldehyde or keto groups of saccharides or polysaccharides or mixtures thereof. It is extremely advantageous to use the reaction products of polyvinyl alcohol and starch. Furthermore, the water solubility can be altered and thus set at desired values in a targeted manner by complexing with Ni or Cu salts or by treatment with dichromates, boric acid, or borax.

Surprisingly, it was found that PVOH is particularly well suited to producing second phases that meet the specifications outlined above. At least one second phase that additionally comprises polyvinyl alcohol and at least one polyhydric alcohol is therefore particularly preferred.

Surprisingly, it was found that above-mentioned benzylidene alditol together with anionic polymers or copolymers, in particular with sulfopolymers, leads to the formation of said shaped bodies of the second phases having non-sensitive surfaces. Such surfaces can be touched by an end consumer without having material adhere to their hands. Nor does any erosion of material occur in packaging. The second phase therefore preferably comprises in addition at least one anionic copolymer/polymer. The proportion of anionic polymer is preferably 1 wt. % to 35 wt. %, in particular 3 wt. % to 30 wt. %, particularly 5 wt. % to 25 wt. %, preferably 5 wt. % to 20 wt. %, based on the total weight of the second phase.

Sulfopolymers also provide the surface of the above-mentioned shaped body with an outstanding luster. What is more, fingerprints are not left behind. Therefore, the proportion of sulfopolymers, in particular sulfopolymers having 2-methyl-2-[(1-oxo-2-propene-1-yl)amino]-1-propane sulfonic acid(salt) (AMPS) as a sulfonic acid group-containing monomer, for example Acusol 590, Acusol 588 or Sokalan CP50, is preferably 1 wt. % to 25 wt. %, in particular 3 wt. % to 15 wt. %, particularly 4 wt. % to 12 wt. %, preferably 5 wt. % to 10 wt. %, based on the total weight of the second phase.

According to the invention, sulfopolymers comprise at least one sulfonic acid group-containing monomer. For sulfonic acid group-containing monomers, those of formula $R^5(R^6)C{=}C(R^7)—X—SO_3H$ are preferred, in which $R^5$ to $R^7$, independently of one another, represent —H, —$CH_3$, a straight-chain or branched saturated alkyl functional group having 2 to 12 carbon atoms, a straight-chain or branched, mono- or polyunsaturated alkenyl functional group having 2 to 12 carbon atoms, with —$NH_2$, —OH, or —COOH substituted alkyl or alkenyl functional groups, or represent —COOH or —$COOR^4$, where $R^4$ is a saturated or unsaturated, straight-chain or branched hydrocarbon functional group having 1 to 12 carbon atoms, and X represents an optionally present spacer group that is selected from —$(CH_2)_n$, where n=0 to 4, —COO—$(CH_2)_k$—, where k=1 to 6, —C(O)—NH—$C(CH_3)_2$—, —C(O)—NH—$C(CH_3)_2$—$CH_2$— and —C(O)—NH—$CH(CH_3)$—$CH_2$—.

Amongst said monomers, those of formulas $$H_2C{=}CH—X—SO_3H,\ H_2C{=}C(CH_3)—X—SO_3H \text{ or } HO_3S—X—(R^6)C{=}C(R^7)—X—SO_3H$$

are preferred, in which $R^6$ and $R^7$, independently of one another, are selected from —H, —$CH_3$, —$CH_2CH_3$, —$CH_2CH_2CH_3$ and —$CH(CH_3)_2$, and X represents an optionally present spacer group that is selected from —$(CH_2)_n$—, where n=0 to 4, —COO—$(CH_2)_k$—, where k=1 to 6, —C(O)—NH—$C(CH_3)_2$—, —C(O)—NH—C$(CH_3)_2$—$CH_2$— and —C(O)—NH—$CH(CH_3)$—$CH_2$—.

Particularly preferred sulfonic acid group-containing monomers are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allyl sulfonic acid, methallyl sulfonic acid, allyloxybenzene sulfonic acid, methallyloxybenzene sulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropylacrylate, 3-sulfopropylmethacrylate, sulfomethacrylamide, sulfomethylmethacrylamide, as well as mixtures of the above acids or water-soluble salts thereof. The sulfonic acid groups can be present in the polymers in a fully or partially neutralized form, i.e. the acidic hydrogen atom of the sulfonic acid group can be replaced in some or all of the sulfonic acid groups with metal ions, preferably alkali metal ions, and in particular with sodium ions. The use of partially or fully neutralized sulfonic acid group-containing copolymers is preferred according to the invention.

In copolymers that contain only carboxylic acid group-containing monomers and sulfonic acid group-containing monomers, the monomer distribution of the copolymers that are preferably used according to the invention is preferably 5 to 95 wt. % in each case; particularly preferably, the proportion of the sulfonic acid group-containing monomer is 50 to 90 wt. %, and the proportion of the carboxylic acid group-containing monomer is 10 to 50 wt. %, with the monomers preferably being selected from those mentioned above. The molar mass of the sulfo-copolymers that are preferably used according to the invention can be varied in order to adapt the properties of the polymers to the desired intended use. Preferred cleaning agents are characterized in that the copolymers have molar masses of from 2,000 to 200,000 $gmol^{-1}$, preferably 4,000 to 25,000 $gmol^{-1}$, and in particular 5,000 to 15,000 $gmol^{-1}$.

In another preferred embodiment, the copolymers comprise not only a carboxyl group-containing monomer and sulfonic acid group-containing monomer but also at least one non-ionic, preferably hydrophobic monomer. It was possible to even further improve the aforementioned properties of the shaped body by using these hydrophobically modified polymers.

In order to stabilize said shaped body of the second composition, it is preferable for the second composition to additionally contain at least one stabilizer, selected from magnesium oxide, salt of Mg, Ca, Zn, Na or K (in particular sulfate, carbonate or acetate, more preferably magnesium sulfate, zinc acetate or calcium acetate), acetamide monoethanolamine, hexamethylenetetramine, guanidine, polypropylene glycol ether, salt of amino acids, or mixtures thereof.

Preferred inorganic zinc salts include the zinc salts (vide supra) which can be used as glass corrosion inhibitors.

The viscoelastic and solid shaped body of the portion according to the invention can be prepared by a liquid composition, containing, based on the total weight thereof, a total amount of more than 1 wt. % of at least one benzylidene alditol compound of formula (I), where *—, n, m, $R^1$, $R^2$, $R^3$, $R^4$, $R^5$ and $R^6$ are as defined in the appended claims, initially being brought to a temperature above the sol-gel transition temperature of the liquid composition, and subsequently the heated liquid composition being introduced into a mold, preferably into a cavity of a cavity mold, and being cooled in said mold to below the sol-gel transition temperature in order to form a viscoelastic, solid shaped body.

The liquid composition is cooled to below the sol-gel transition temperature so as to cure the liquid composition. In this case, it is preferable according to the invention for the liquid composition to be cooled to no lower than 20° C., in particular to no lower than 25° C., particularly preferably to no lower than 30° C., in order to form the above-mentioned shaped body.

Depending on the material of the cavity mold, it may be favorable, for easier removal of the shaped body from this mold, in particular the cavity of a cavity mold, that before the heated liquid composition is placed into the mold, preferably into the (I)

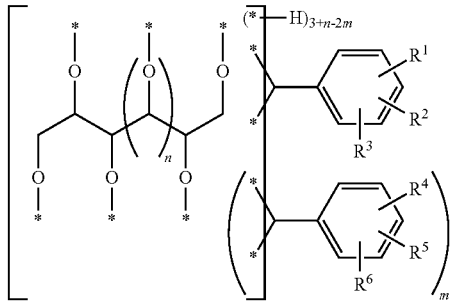

cavity of a cavity mold, the mold is lined with a film of water-soluble material. As appropriately suitable water-soluble material or preferred water-soluble material, use should be made of the water-soluble material of the walls of the portion (vide supra).

If the mold is lined with a film before being filled with the liquid composition, then, after the liquid composition has been cured to form said viscoelastic, solid shaped body, the shaped body can remain in the mold for further preparation of the portion according to the invention. In this case, in a method for preparing a portion, the viscoelastic, solid shaped body is left in the mold, preferably in the cavity mold, then, subsequently to the shaped body, a granular mixture of a solid composition is introduced into a mold, preferably into the same mold, and the shaped body and granular mixture (preferably in contact therewith) are coated with a water-soluble material in such a way that the shaped body and the granular mixture are packed in at least one chamber, preferably together in the same chamber, having a wall made of said water-soluble material. Again, it is preferable for the shaped body located in the mold and granular mixture to be brought into contact with a second film of water-soluble material and the second film to be sealed with the film lining the mold so as to form at least one chamber and a sealing seam.

The present invention further relates to a method for preparing portions, in particular cleaning agent portions, that contain an agent comprising at least one first phase and at least one different second phase, the method comprising:

a) providing a mold having at least one mold cavity, optionally containing a partition for dividing the base of the mold cavity;
b) adding a water-soluble film onto the mold cavity;
c) forming an open chamber in the mold cavity by deforming the water-soluble film;

d) filling the open chamber or parts thereof with at least one second phase as described above or with the temperature-controlled, liquid composition required for preparing the second phase, as described above;

e) optionally filling the open chamber or parts thereof with at least one further second phase as described above, it being possible for said second phase to optionally differ from the second phase according to d);

f) optionally leaving the second phase(s) to set;

g) subsequently filling the open chamber with at least one first phase that is different from the at least one second phase, as described above;

h) providing a second water-soluble film as a cover;

i) superimposing the open chamber and the cover in order to seal the portion at a sealing region;

j) sealing the cover with the open chamber.

The mold comprises at least one cavity (mold cavity). For example, the mold may be provided as a single mold or as part of an array of molds in the form of a conveyor belt, as is known from the conveyor belt method and from the drum method. The mold comprises a region on which the film can be placed, e.g. a seal region which is typically defined around the opening in a mold cavity. The mold cavity can have different geometries; if there are edges, it is advantageous for them to be rounded. Rounded edges and/or dome-shaped cavities are designed to ensure that the film is pulled somewhat more homogeneously upon being pulled into the cavity, thereby keeping the film thickness uniform in this respect, and that no breakage or tear points are produced, which in turn results in a more stable portion pack.

Optionally, but according to a particular embodiment, the mold preferably contains at least one mold cavity which has a partition for dividing the base of the mold cavity. As a result, bulges or pockets form in the molded chamber, which visually create a positive appearance. In particular, if only the regions of these bulges are completely or partially, preferably almost completely, filled with the second phase(s), this region is again clearly separated from the granular mixture of the first phase, and produces a visually very good appearance.

The water-soluble film can be fed from a roll and guided onto the mold cavity. The film is positioned and held in place on the mold. The film can be held in place by means of suction holes on the mold surface, which is not part of the mold cavity. However, the film can also be held on the mold by mechanical means, for example clips. For example, the film may be held in place by a stamp which presses on the seal region. In continuous production methods, e.g. drum methods and conveyor belt methods, it is preferable for the speed of the film to be matched to the speed of the conveyor belt formed from the molds, such that the film is not unnecessarily pulled thinner on account of being held in place on a running mold.

After the film is held in place relative to the mold cavity, a chamber is formed in the mold cavity region by adapting the film at least in part to the mold cavity. The film is adapted by means of elastic and/or plastic deformation. Preferably, the film deformation has a greater plastic than elastic proportion. The deformation of the water-soluble film is produced for example by deep-drawing or by means of a suitable stamp. A preferred variant is deep-drawing, by applying negative pressure (forming pressure) in the mold cavity; for this purpose, the mold cavity preferably comprises small openings, preferably in the bottom region, which are connected in terms of air pressure to a vacuum pump by means of corresponding lines.

After forming the open chamber, said chamber or parts thereof are filled in step d) with the at least one second phase of the product or the temperature-controlled, liquid composition thereof provided for setting. As soon as the at least one second phase has set, if necessary after an additional period of time required for setting, further product constituents (further second phases according to optional step e) or at least one first phase according to step g)) can then be introduced into the chamber. In this case, the at least one first phase according to step g) is preferably free-flowing.

It is preferable in the above-mentioned production method for the chamber containing the second phase to not be completely filled with the second phase(s) (in step d). In this case, the chamber may preferably be filled with the second phase(s) only in part, preferably only in the lower region or only in the region or just above the region of the bulges or pockets of the chamber formed by the optional partition according to a).

If the chamber or parts thereof is filled with at least two second phases, it is preferred according to a particular embodiment for these second phases to be substantially the same or differ only slightly, for example by a different dye. The phases preferably have a very similar, in particular the same, composition with regard to the active substances used (apart from auxiliaries such as dyes). This avoids in particular migration phenomena between the second phases and thus a non-advantageous visual impression during storage on account of inflated or shrunken phases, for example.

When filling with product, the deformed film is preferably still held in the cavity during filling. For example, when negative pressure is applied, the negative pressure is broken only after sealing. In this case, the negative pressure after forming the chamber, in relation to the forming pressure, may have a lower strength (higher pressure), which fulfills only the holding function.

The chamber is filled by introducing at least one first and at least one second phase, in particular by those described above as being in accordance with the invention.

It is important for the seal region to remain free of product. For example, if the chamber is at least partly elastically deformed, this elastic deformation, after filling and prior to sealing, should not be such that the product flows over and out of the open chamber and thus contaminates the seal region.

According to a particular embodiment, the cover is positioned on the open chamber such that in the next step the cover can be placed on the sealing region. The position of the cover is generally determined relative to the position of the chamber. If the chamber moves together with a movable mold on a conveyor belt, the cover has to move in the same way so that the position relative to the chamber remains the same.

The cover is then placed on to the open chamber, which is closed in this way. The contact between the cover and the film in the sealing region thus closes the chamber.

A preferred embodiment of the seal is a material fusion between the film and the cover, for example by solvating the film before applying the cover, or by melting the film and/or cover in the sealing region. Alternatively, the sealing is carried out by gluing or welding.

The positioning, applying, and sealing can take place either in separate steps or simultaneously.

The mold can also comprise at least one second mold cavity such that at least two open chambers are produced by method steps a) to d). The at least two chambers are formed in the same plane. It is preferable, in method step h), for the cover to be positioned over the at least two open chambers and, in method step i), for the cover to be placed on at least the two chambers in order to seal the portion at a sealing region. Since the at least two chambers are connected to the same cover, the chambers remain in a particular position relative to one another, in contrast with the prior art, in which adjacent chambers are connected by means of the partition that is formed by the thin films of the packages.

It is particularly preferable for the cover to be provided as part of a strip, by feeding/transferring a strip that comprises at least one cover. Separating the cover may take place prior to positioning, after positioning but before being placed on, while being placed on, or after being placed onto the chamber.

When separated before positioning, the cover is preferably punched out.

The cover and the film may also be separated simultaneously with the sealing. The device which produces the seal by melting consists of at least two parts: one is the mold itself and the other part is a counter-stamp which presses on the mold from the cover side. It is preferred that, in the sealing step, the pressure exerted during sealing at the sealing region by the mold and a further part must be lower than the pressure exerted in the separation region. The separation region surrounds the sealing region.

In the case of separation after sealing, the cover and film are alternatively preferably separated from the strip in the same step, and thus the portion packs are separated.

As an alternative, equally preferred method for preparing portions according to the invention, the following is suitable in particular. This method comprises the following steps:

a) providing a mold having at least one mold cavity, optionally containing a partition for dividing the base of the mold cavity;
b) adding a water-soluble film onto the mold cavity;
c) forming an open chamber in the mold cavity by deforming the water-soluble film;
d) filling the open chamber with at least one granular mixture of the first phase;
e) providing a second mold having at least one second mold cavity, optionally containing a partition for dividing the base of the mold cavity;
f) adding a second water-soluble film onto the second mold cavity;
g) forming a second open chamber in the second mold cavity by deforming the water-soluble film;
h) filling the second open chamber or parts thereof with at least one second phase as described above;
i) optionally filling the second open chamber or parts thereof from step h) with at least one further second phase as described above (or the temperature-controlled, liquid composition required for preparing the second phase, as described above), this at least one further second phase being optionally different from the second phase according to h);
j) optionally leaving the second phase(s) to set;
k) superimposing the two open chambers in order to seal the portion pack at a sealing region, the filled regions facing one another;
l) sealing the open chambers together.

Unless stated otherwise, that which was described for the first method also applies to this method.

In this second method, two different chambers are formed, with one chamber containing at least one first phase and the other chamber containing at least one second phase.

Preferably, in step k), the chamber containing the at least one granular mixture of a first phase, in particular a granular, free-flowing mixture of a first phase, is arranged such that the mixture does not fall out.

In this case, the chamber containing the at least one second phase is then preferably arranged over/above the chamber containing the at least one first phase. In this case, the filled chamber regions face one another. It is important that, in step k), the liquid composition used to prepare the second phase is already set or gel-like or no longer flowable such that it does not run out of the chamber. After sealing, this results in a multi-phase single-chamber pouch, which has a particularly good appearance.

For both above-mentioned production methods, the following preferably applies:

For the at least one first phase, that which has been described above applies to the cleaning agents according to the invention. It is preferable in this case for the at least one first phase to be free-flowing. In particular, the free-flowing ability of the at least one first phase preferably has a value of greater than 55%, in particular greater than 60%, particularly preferably between 63% and 80%, for example between 65% and 75%, with respect to the standard test sand.

For the at least one second phase to be used in the methods according to the invention, the same applies as that which has been stated above, to which reference is explicitly made.

Depending on the production method, the second phase(s) may be significantly above or below the sealing seam plane (former method) or approximately at the level of the sealing seam plane (latter method).

The invention also relates to a method for treating substrates, comprising the following method steps:

(a) providing a surfactant-containing liquor by mixing from 0.5 L to 40.0 L of water with a portion according to the appended claims, and (b) bringing a substrate, in particular a textile or dishes, into contact with the surfactant-containing liquor prepared according to (a).

The following points constitute particular embodiments of the invention:

1. A portion for providing a surfactant-containing liquor, comprising at least one chamber having a wall made of water-soluble material, the portion comprising an agent which contains, based on the total weight of the agent, a total amount of from 0.1 to 80 wt. % of at least one surfactant, said agent comprising at least two phases, characterized in that a) a first phase is a granular mixture of a solid composition, and b) a second phase is present as a viscoelastic, solid shaped body of a second composition, which contains, based on the total weight of the second composition, a total amount of more than 1 wt. % of at least one benzylidene alditol compound of formula (I), (I)

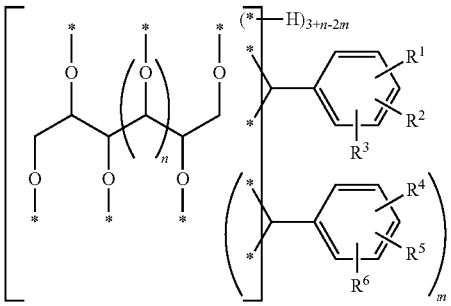

where

— represents a covalent single bond between an oxygen atom of the alditol backbone and the provided functional group, n represents 0 or 1, preferably 1, m represents 0 or 1, preferably 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxyl group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxyl group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring.

2. The portion according to point 1, characterized in that the second composition has a storage modulus of between $10^3$ Pa and $10^8$ Pa, preferably between $10^4$ Pa and $10^8$ Pa and a loss modulus (at 20° C., with a deformation of 0.1% and a frequency of 1 Hz), and the storage modulus in the frequency range between $10^{-2}$ Hz and 10 Hz is at least twice as great as the loss modulus, preferably five times greater than the loss modulus, particularly preferably at least ten times greater than the loss modulus.

3. Portion according to point 1 or 2, characterized in that the agent contained therein contains at least one anionic surfactant.

4. The portion according to point 3, characterized in that the agent contained therein contains at least one anionic surfactant selected from the group consisting of $C_{8-18}$ alkylbenzene sulfonates, olefin sulfonates, $C_{12-18}$ alkane sulfonates, ester sulfonates, alkyl sulfates, alkenyl sulfates, fatty alcohol ether sulfates and mixtures thereof.

5. The portion according to one of points 1 to 4, characterized in that the agent contained therein contains, as surfactant, at least one compound of formula (T1), (T1)

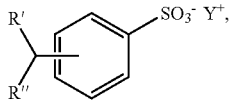

in which

R' and R" signify, independently of one another, H or alkyl, and together contain 9 to 19, preferably 9 to 15 and in particular 9 to 13, C atoms, and $Y^+$ is a monovalent cation or the nth part of an n-valent cation (in particular $Na^+$).

6. The portion according to one of points 1 to 5, characterized in that the agent contained therein contains at least one non-ionic surfactant.

7. The portion according to one of points 1 to 6, characterized in that the agent contained therein contains, as surfactant, at least one non-ionic surfactant of formula (T2), $$R^2—O—(XO)_m—H, \quad (T2)$$

in which $R^2$ represents a linear or branched $C_8$-$C_{18}$ alkyl functional group, an aryl functional group or an alkyl aryl functional group, XO independently of each other represent an ethylene oxide (EO) group or a propylene oxide (PO) group, m represents integers from 1 to 50.

8. The portion according to one of points 1 to 7, characterized in that the agent contained therein contains, as surfactant, at least one non-ionic surfactant of the general formula $$R^1—CH(OH)CH_2O-(AO)_w-(AO)_x-(A''O)_y-(A'''O)_z—R^2$$

in which $R^1$ represents a straight-chain or branched, saturated or mono- or polyunsaturated $C_{6-24}$ alkyl functional group or alkenyl functional group;

$R^2$ represents hydrogen or a linear or branched hydrocarbon functional group having 2 to 26 carbon atoms;

A, A', A" und A''' represent, independently of one another, a functional group from the group —$CH_2CH_2$, —$CH_2CH_2$—$CH_2$, —$CH_2$—CH($CH_3$), —$CH_2$—$CH_2$—$CH_2$—$CH_2$, —$CH_2$—CH($CH_3$)—$CH_2$—, —$CH_2$—CH($CH_2$—$CH_3$);

w, x, y and z represent values of between 0.5 and 120, where x, y and/or z can also be 0.

9. The portion according to one of points 1 to 8, characterized in that the alditol backbone of the benzylidene alditol compound according to formula (I) contained in the second composition is derived from D-glucitol, D-mannitol, D-arabinitol, D-ribitol, D-xylitol, L-glucitol, L-mannitol, L-arabinitol, L-ribitol, or L-xylitol.

10. The composition according to one of points 1 to 9, characterized in that $R^1$, $R^2$, $R_3$, $R^4$, $R^5$ and $R^6$ signify, independently of one another, a hydrogen atom, methyl, ethyl, chlorine, fluorine, or methoxy, preferably a hydrogen atom.

11. The portion according to one of points 1 to 10, characterized in that the second composition contains, as a benzylidene alditol compound of formula (I), at least one compound of formula (I-1)

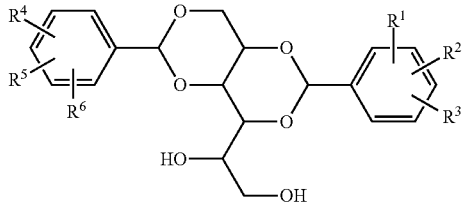

(I-1)

where $R^1$, $R^2$, $R^3$, $R^4$, $R^5$ and $R^6$ are as defined in point 1.

12. The portion according to one of points 1 to 11, characterized in that the benzylidene alditol compound of formula (I) is selected from 1,3:2,4-di-O-benzylidene-D-sorbitol; 1,3:2,4-di-O-(p-methylbenzylidene)-D-sorbitol; 1,3:2,4-di-O-(p-chlorobenzylidene)-D-sorbitol; 1,3:2,4-di-O-(2,4-dimethylbenzylidene)-D-sorbitol; 1,3:2,4-di-O-(p-ethylbenzylidene)-D-sorbitol; 1,3:2,4-di-O-(3,4-dimethylbenzylidene)-D-sorbitol or mixtures thereof.

13. The portion according to one of points 1 to 12, characterized in that the benzylidene alditol compound of formula (I) is contained in the second composition in a total amount of more than 1.5 wt. %, in particular more than 2.0 wt. %.

14. The portion according to one of points 1 to 13, characterized in that water is contained in the second composition in a total amount of from 0 to 40 wt. %, preferably from 0 to 25 wt. %.

15. The portion according to one of the preceding points, characterized in that the second composition additionally contains at least one organic solvent having at least one hydroxyl group, no amino group and having a molecular weight of at most 500 g/mol (preferably selected from ($C_2$-$C_8$) alkanols having at least one hydroxyl group (particularly preferably ethanol, ethylene glycol, 1,2-propanediol, glycerol, 1,3-propanediol, n-propanol, isopropanol, 1,1,1-trimethylolpropane, 2-methyl-1,3-propanediol, 2-hydroxymethyl-1,3-propanediol), triethylene glycol, butyl diglycol, polyethylene glycols having a weight-average molar mass $M_w$ of at most 500 g/mol, glycerol carbonate, propylene carbonate, 1-methoxy-2-propanol, 3-methoxy-3-methyl-1-butanol, butyl lactate, 2-isobutyl-2-methyl-4-hydroxymethyl-1,3-dioxolane, 2,2-dimethyl-4-hydroxymethyl-1,3-dioxolane, dipropylene glycol, or mixtures thereof).

16. The portion according to point 15, characterized in that said organic solvent is contained in a total amount of from 5 to 95 wt. %, in particular from 20 to 90 wt. %.

17. The portion according to one of the preceding points, characterized in that at least one polyalkylene oxide compound having a weight-average molar mass $M_w$ of at least 4,000 g/mol is additionally contained in the second composition.

18. The portion according to point 17, characterized in that said polyalkylene oxide compound is selected from polyethylene oxide, ethylene oxide-propylene oxide copolymer, and mixtures thereof.

19. The portion according to one of the preceding points, characterized in that at least one polymeric polyol, in particular polyvinyl alcohol, is additionally contained.

20. The portion according to one of points 2 to 19, characterized in that the second composition has a storage modulus in a range of from $10^5$ Pa to $10^7$ Pa.

21. The portion according to one of the preceding points, characterized in that the second composition additionally contains at least one stabilizer, selected from magnesium sulfate, zinc acetate, calcium acetate, magnesium oxide, salt (in particular sulfate, acetate or carbonate) of Mg, Ca, Zn, Na or K, acetamide monoethanolamine, hexamethylenetetramine, guanidine, polypropylene glycol ether, salt of amino acids, or mixtures thereof.

22. The portion according to one of the preceding points, characterized in that the shaped body of the second phase is obtained by bringing the initially liquid second composition to a temperature above the sol-gel transition temperature of the second composition and then cooling it.

23. The portion according to one of the preceding points, characterized in that the average grain size (volume average) $X_{50.3}$ of the granular mixture of the first phase is in a range of from 10 μm to 1,500 μm, preferably from 200 μm to 1,200 μm, particularly preferably from 600 μm to 1,100 μm.

24. The portion according to one of the preceding points, characterized in that the first phase and the second phase are contained together in the same chamber.

25. The portion according to one of the preceding points, characterized in that the granular mixture of the first phase is in direct contact with the shaped body of the second phase.

26. The portion according to one of the preceding points, characterized in that the walls are formed of water-soluble material containing polyvinyl alcohol.

27. The portion according to one of the preceding points, characterized in that walls of at least one chamber are produced by sealing at least one film made of water-soluble material, in particular by sealing within the context of the form fill sealing process.

28. The portion according to one of the preceding points, characterized in that the second composition has a yield point in the range of from 10 to 350 Pa, preferably from 15 to 320 Pa, particularly preferably from 18 to 300 Pa, measured in each case using: a rotational viscometer and a cone-plate measuring system of 40 mm diameter and a 2° opening angle at a temperature of 20° C.

29. A method for treating substrates, comprising the following method steps:

a) providing a surfactant-containing liquor by mixing from 0.5 L to 40.0 L of water with a portion according to one of points 1 to 28, and b) bringing a substrate, in particular a textile or dishes, into contact with the surfactant-containing liquor prepared according to (a).

30. A method for preparing a solid shaped body, in which a liquid composition, containing, based on the total weight thereof, a total amount of more than 1 wt. % of at least one benzylidene alditol compound of formula (I),

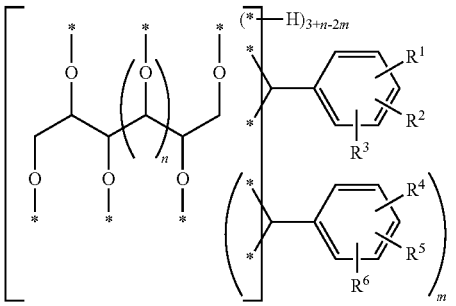

(I)

where *—, n, m, $R^1$, $R^2$, $R^3$, $R^4$, $R^5$ and $R^6$ are as defined in point 1, is initially brought to a temperature above the sol-gel transition temperature of the liquid composition, and subsequently the heated liquid composition is introduced into a mold, preferably into the cavity of a cavity mold, and is cooled in said mold to below the sol-gel transition temperature in order to form a viscoelastic, solid shaped body.

31. The method according to point 30, characterized in that, before the heated liquid composition is placed into the mold, preferably into the cavity of the cavity mold, the cavity is lined with a film made of water-soluble material.

32. A method for preparing a portion, wherein a viscoelastic, solid shaped body is prepared according to the methods of points 30 or 31 and the shaped body is left in the mold, preferably in the cavity mold, then, subsequently to the shaped body, a granular mixture of a solid composition is introduced into a mold, preferably into the same mold, and the shaped body and granular mixture (preferably in contact therewith) are coated with a water-soluble material in such a way that the shaped body and the granular mixture are packed in at least one chamber, preferably together in the same chamber, having a wall made of said water-soluble material.

33. The method according to point 32, characterized in that the viscoelastic, solid shaped body is prepared according to the method of point 30 and the shaped body is left in the mold, preferably in the cavity mold, and the shaped body located in the mold and granular mixture are brought into contact with a second film made of water-soluble material and the second film is sealed with the film lining the mold so as to form at least one chamber and a sealing seam.

EXAMPLES

Shaped bodies S1-S15 according to Table 1 and Table 2 were produced.

While stirring, a mixture of the corresponding ingredients was prepared, and the mixture was heated to 128° C. until all ingredients had dissolved. 10 ml of this solution was added into a cavity mold which was previously lined with a deep-drawn polyvinyl alcohol film (M8630 from Monosol together with denatonium benzoate integrally incorporated into the film material). The temperature of the solution in the cavities was gradually lowered to room temperature. Thereafter, 15 g of a commercially available, powdered machine dishwashing detergent were placed into the cavity on the solidified, viscoelastic shaped body and the filled cavity was covered with a second film M8630 and sealed. All shaped bodies S1 to S15 have a storage modulus in the order of magnitude of $10^6$ Pa, which was at least ten times greater than the loss modulus.

TABLE 1 compositions of the shaped bodies S1 to S7

| | S1 | S2 | S3 | S4 | S5 | S6 | S7 |
|---|---|---|---|---|---|---|---|
| 1,2-propanediol | 77.03 | 76.03 | 74.53 | 79.61 | 72.61 | 76.11 | 70.11 |
| PEG 12000 | — | — | — | — | 5.00 | — | — |
| Marlox FK 64 [1] | — | — | — | 5.00 | 5.00 | 5.00 | 5.00 |
| Plurafac LF 220 [2] | 10.58 | 10.58 | 10.58 | 5.00 | 5.00 | 5.00 | 5.00 |
| Water | 9.39 | 9.39 | 9.39 | 9.39 | 9.39 | 9.39 | 9.39 |
| Zinc acetate | — | 1.00 | 2.50 | — | — | 1.50 | 2.50 |
| 1,3:2,4-O-Dibenzyliden-D-sorbitol | 3.00 | 3.00 | 3.00 | 1.00 | 3.00 | 3.00 | 3.00 |

[1] $C_{10-12}$ fatty alcohol, ethoxylated und propoxylated (6 PO & 4 EO) (Sasol)

[2] linear and branched fatty alcohols alkoxylated with ethylene oxide and higher alkylene oxide (BASF)

TABLE 2

Compositions of the shaped bodies S8 to S15

| | S8 | S9 | S10 | S11 | S12 | S13 | S14 | S15 |
|---|---|---|---|---|---|---|---|---|
| 1,3-propanediol | — | — | — | — | — | | 35.00 | — |
| 1,2-propanediol | 75.53 | 72.61 | 76.61 | 76.11 | 92.00 | 29.08 | | 33.50 |
| Glycerol | — | — | — | — | — | 29.13 | 36.00 | 33.50 |
| PEG 400 | — | — | — | — | — | 7.77 | 8.00 | 8.00 |
| PEG 4000 | — | — | 1.00 | — | — | — | — | — |
| PEG 12000 | — | 5.00 | — | — | — | — | — | — |
| Marlox FK 64 | — | 5.00 | 5.00 | 5.00 | — | — | — | — |
| Plurafac LF 220 | — | 5.00 | 5.00 | 5.00 | — | — | — | — |
| Water | 9.39 | 9.39 | 9.39 | — | — | — | — | — |

TABLE 2-continued

| Compositions of the shaped bodies S8 to S15 | | | | | | | | |
|---|---|---|---|---|---|---|---|---|
| | S8 | S9 | S10 | S11 | S12 | S13 | S14 | S15 |
| Zinc acetate | 1.50 | — | — | 9.39 | — | — | — | — |
| Citric acid | — | — | — | 1.50 | — | 5.83 | — | — |
| Acusol 590 [3] | 10.58 | — | — | — | — | 7.77 | 8.00 | 8.00 |
| 1.3:2,4-O-dibenzylidene sorbitol | 3.00 | 3.00 | 3.00 | — | 3.00 | 3.00 | 3.00 | 1.00 |
| Mowiol 4-88 [4] | — | — | — | 3.00 | 5.00 | 10.00 | 10.00 | 16.00 |

[3] copolymer with AMPS
[4] polyvinyl alcohol

It was found that, even in the absence of a surfactant liquid-crystalline phase, a stable viscoelastic, solid composition can be obtained using benzylidene alditol (in this case dibenzylidene sorbitol) in specific amounts.

The single-chamber portions obtained by m=eans of these viscoelastic compositions were stable even after four weeks of storage and had a good dissolution rate of the ingredients or phases in water. The phase separation in the portion remained concise despite contact of the granular mixture with the viscoelastic shaped body.

In comparison with the conventional shaped bodies, the shaped bodies S8 and S13 to S15 exhibited a shinier surface and nevertheless sufficient breaking strength.

What is claimed is:

1. A portion for providing a surfactant-containing liquor, comprising at least one chamber having a wall made of water-soluble material, the portion comprising an agent which contains, based on the total weight of the agent, a total amount from 0.1 to 80 wt. % of at least one surfactant, said agent comprising at least two phases, characterized in that a) a first phase is a granular mixture of a solid composition, and b) a second phase is present as a viscoelastic, solid shaped body of a second composition, which comprises, based on the total weight of the second composition, a total amount of more than 1 wt. % of at least one benzylidene alditol compound of formula (I), (I)

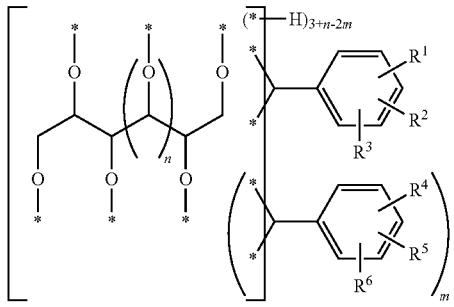

where

*- represents a covalent single bond between an oxygen atom of the alditol backbone and the provided functional group, n represents 0 or 1, m represents 0 or 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxyl group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxyl group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring;

wherein the second composition i) further comprises at least one stabilizer selected from the group consisting of magnesium sulfate, zinc acetate, calcium acetate, acetamide monoethanolamine, hexamethylenetetramine, guanidine, polypropylene glycol ether, salt of amino acids, or mixtures thereof;

ii) further comprises at least one organic solvent selected from the group consisting of;

a solvent having at least one hydroxyl group, no amino group, and having a molecular weight of at most 500 g/mol, triethylene glycol, butyl diglycol, polyethylene glycols having a weight-average molar mass Mw of at most 500 g/mol, glycerol carbonate, propylene carbonate, 1-methoxy-2-propanol, 3-methoxy-3-methyl-1-butanol; butyl lactate, 2-isobutyl-2-methyl-4-hydroxymethyl-1,3-dioxolane, 2,2-dimethyl-4-hydroxymethyl-1,3-dioxolane, dipropylene glycol, or mixtures thereof; and iii) has a storage modulus of between $10^3$ Pa and $10^8$ Pa and a loss modulus (at 20° C., with a deformation of 0.1% and a frequency of 1 Hz), and the storage modulus in the frequency range between $10^{-2}$ Hz and 10 Hz is at least twice as great as the loss modulus.

2. The portion according to claim 1, wherein the agent contained therein comprises at least one non-ionic surfactant.

3. The portion according to claim 1, wherein the agent contained therein comprises, as the surfactant, at least one non-ionic surfactant of the general formula $$R^1—\underset{R^2}{CH(OH)}CH_2O\text{-}(AO)_w\text{-}(AO)_x\text{-}(A''O)_y\text{-}(A'''O)_z—$$

in which $R^1$ represents a straight-chain or branched, saturated or mono- or polyunsaturated $C_{6-24}$ alkyl functional group or alkenyl functional group;

$R^2$ represents hydrogen or a linear or branched hydrocarbon functional group having 2 to 26 carbon atoms;

A, A', A" and A'" represent, independently of one another, a functional group from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$;

w, x, y and z represent values of between 0.5 and 120, where x, y and/or z can also be 0.

4. The portion according to claim 1, wherein the alditol backbone of the benzylidene alditol compound contained in the second composition according to formula (I) is derived from D-glucitol, D-mannitol, D-arabinitol, D-ribitol, D-xylitol, L-glucitol, L-mannitol, L-arabinitol, L-ribitol, or L-xylitol.

5. The portion according to claim 1, wherein $R^2$, $R^3$, $R^4$, $R^5$ and $R^6$ according to formula (I) signify, independently of one another, a hydrogen atom, methyl, ethyl, chlorine, fluorine, or methoxy.

6. The portion according to claim 1, wherein the second composition comprises, as a benzylidene alditol compound of formula (I), at least one compound of formula (I-1)

(I-1)

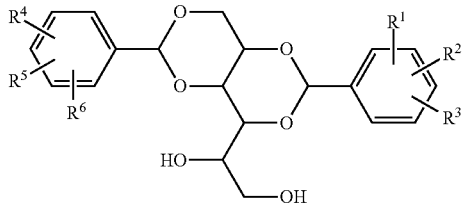

where $R^1$, $R^2$, $R^3$, $R^4$, $R^5$ and $R^6$ are as defined in claim 1.

7. The portion according to claim 1, wherein the benzylidene alditol compound of formula (I) is selected from 1,3:2,4-di-O-benzylidene-D-sorbitol; 1,3:2,4-di-O-(p-methylbenzylidene)-D-sorbitol; 1,3:2,4-Di-O-(p-chlorobenzylidene)-D-sorbitol; 1,3:2,4-di-O-(2,4-dimethylbenzylidene)-D-sorbitol; 1,3:2,4-Di-O-(p-ethylbenzylidene)-D-sorbitol; 1,3:2,4-di-O-(3,4-dimethylbenzylidene)-D-sorbitol or mixtures thereof.

8. The portion according to claim 1, wherein the benzylidene alditol compound of formula (I) is contained in the second composition in a total amount of more than 1.5 wt. %.

9. The portion according to claim 1, wherein water is contained in the second composition in a total amount-from 0 to 40 wt. %.

10. The portion according to claim 1, wherein said organic solvent comprises a total amount-from 5 to 95 wt. %.

11. The portion according to claim 1, further comprising at least one polymeric polyol.

12. The portion according to claim 1, wherein the first phase and the second phase are contained together in the same chamber.

13. The portion according to claim 2, wherein the second composition has a storage modulus of between $10^4$ Pa and $10^8$ Pa.

14. The portion according to claim 2, wherein the storage modulus of the second composition is at least five times greater than the loss modulus.

15. The portion according to claim 2, wherein the storage modulus of the second composition is at least ten times greater than the loss modulus.

16. The portion according to claim 5, wherein $R^1$, $R^2$, $R^3$, $R^4$, $R^5$ and $R^6$ according to formula (I) signify, independently of one another, a hydrogen atom.

* * * * *